US010831160B2

(12) United States Patent
Kinoshita

(10) Patent No.: US 10,831,160 B2
(45) Date of Patent: Nov. 10, 2020

(54) ELECTRONIC DEVICE AND RECEIVING DEVICE

(71) Applicant: Seiko Epson Corporation, Tokyo (JP)

(72) Inventor: Eiji Kinoshita, Matsumoto (JP)

(73) Assignee: Seiko Epson Corporation (JP)

( * ) Notice: Subject to any disclaimer, the term of this patent is extended or adjusted under 35 U.S.C. 154(b) by 355 days.

(21) Appl. No.: 15/918,390

(22) Filed: Mar. 12, 2018

(65) Prior Publication Data

US 2018/0275620 A1 Sep. 27, 2018

(30) Foreign Application Priority Data

Mar. 21, 2017 (JP) ..... 2017-055084

(51) Int. Cl.
*G04R 20/04* (2013.01)
*G04R 20/06* (2013.01)
*G04R 40/06* (2013.01)

(52) U.S. Cl.
CPC ..... *G04R 20/04* (2013.01); *G04R 20/06* (2013.01); *G04R 40/06* (2013.01)

(58) Field of Classification Search
CPC ..... G04R 20/04; G04R 20/06; G04R 40/06
See application file for complete search history.

(56) References Cited

U.S. PATENT DOCUMENTS 5,805,530 A * 9/1998 Youngberg ..... G04R 20/00 368/10
2004/0190378 A1* 9/2004 Farmer ..... H04W 56/0015 368/47
2005/0135325 A1* 6/2005 Kang ..... G04R 20/14 370/345
2017/0269558 A1 9/2017 Sekitsuka et al.
2018/0246216 A1* 8/2018 Shiina ..... G04R 20/02
2019/0049904 A1* 2/2019 Lagorgette ..... G06T 7/74

FOREIGN PATENT DOCUMENTS

JP 2000-199793 A 7/2000
JP 2017-166944 A 9/2017

* cited by examiner

*Primary Examiner* — Edwin A. Leon
*Assistant Examiner* — Jason M Collins
(74) *Attorney, Agent, or Firm* — Harness, Dickey & Pierce, P.L.C.

(57) ABSTRACT

An electronic device includes: a receiver that receives a satellite signal; and a time corrector that corrects an internal time. The receiver acquires time synchronization information and satellite time information by receiving the satellite signal, detects update timing of seconds on the basis of the time synchronization information, and executes output processing of outputting a synchronization signal, which indicates output timing, and reception side time information including time difference information, which indicates a time difference between the update timing of seconds and the output timing, and time information of hours, minutes, and seconds based on the satellite time information, before next update timing of seconds. The time corrector corrects the internal time on the basis of the synchronization signal and the reception side time information.

8 Claims, 31 Drawing Sheets

ELECTRONIC DEVICE AND RECEIVING DEVICE

BACKGROUND

1. Technical Field

The present invention relates to an electronic device and a receiving device that receive a satellite signal.

2. Related Art

In the related art, there is a known electronic device that receives a satellite signal transmitted from a position information satellite such as a global positioning system (GPS) satellite, acquires time information and position information on the basis of the received signal, and corrects the time on the basis of the acquired information (refer to, for example, JP-A-2000-199793).

The GPS module of the timepiece device of JP-A-2000-199793 receives the satellite signal, acquires the time data, and detects the update timing of seconds (timing of positive seconds). Then, the time data is sent to the main module on the basis of the timing of positive seconds. Then, the main module corrects the time of a timepiece portion on the basis of the acquired time data.

In the timepiece device of JP-A-2000-199793, after acquiring time data, the GPS module transmits data to the main module on the basis of the timing of positive seconds. Therefore, a latency time period from the acquisition of the time data to the next timing of positive seconds occurs. It is desired to shorten the time period necessary for time correction by shortening this latency time.

SUMMARY

An advantage of some aspects of the invention is to provide an electronic device and a receiving device capable of shortening the time period necessary for time correction.

An electronic device according to an aspect of the invention includes: a receiving unit that receives a satellite signal; and a time correction unit that corrects an internal time. The receiving unit acquires time synchronization information and satellite time information by receiving the satellite signal, detects update timing of seconds on the basis of the time synchronization information, and executes output processing of outputting a synchronization signal, which indicates output timing, and reception side time information including time difference information, which indicates a time difference between the update timing of seconds and the output timing, and time information of hours, minutes, and seconds based on the satellite time information, before next update timing of seconds. The time correction unit corrects the internal time on the basis of the synchronization signal and the reception side time information.

According to the aspect of the invention, after acquiring the time synchronization information and the satellite time information, the receiving unit may output the time information of hours, minutes, and seconds based on the synchronization signal, the time difference information, and the acquired satellite time information without waiting for the next update timing of seconds (next timing of positive seconds). Then, the time correction unit may correct the internal time on the basis of the synchronization signal, the time difference information, and the time information of hours, minutes, and seconds. Therefore, as compared with a case where the receiving unit waits for the next update timing of seconds and transmits data, the time period necessary for time correction may be shortened.

An electronic device according to an aspect of the invention includes: a receiving unit that receives a satellite signal; and a time correction unit that corrects an internal time. The receiving unit acquires time synchronization information by receiving the satellite signal, detects update timing of seconds on the basis of the time synchronization information, and executes output processing of outputting a synchronization signal, which indicates output timing, and reception side time information including at least time difference information, which indicates a time difference between the update timing of seconds and the output timing, before next update timing of seconds. In addition, the time correction unit corrects the internal time on the basis of the synchronization signal and the reception side time information.

For example, when a user checks a displayed time of the electronic device periodically and there is a shift in the displayed time, in a case where the time is corrected manually, the error of the internal time is kept to be a small value. In such a manner, when the error of the internal time is kept to be less than ±0.5 seconds, the internal time may be corrected correctly on the basis of the synchronization signal and the time difference information.

According to the aspect of the invention, after acquiring the time synchronization information, the receiving unit may output the synchronization signal and the time difference information without waiting for the next update timing of seconds. Then, the time correction unit may correct the internal time on the basis of the synchronization signal and the time difference information. Therefore, as compared with a case where the receiving unit waits for the next update timing of seconds and transmits data, the time period necessary for time correction may be shortened.

If the receiving unit acquires the time synchronization information, the time correction unit may correct the internal time without acquiring the satellite time information. Therefore, as compared with the case where the time correction unit corrects the internal time after the receiving unit acquires the time synchronization information and the satellite time information, the time period necessary for time correction may be shortened.

It is preferable that the electronic device according to the aspect of the invention further includes an information acquisition unit that acquires the synchronization signal and the reception side time information, which are output through the output processing, and sends the synchronization signal and the reception side time information to the time correction unit and, in a case where the information acquisition unit fails to acquire the synchronization signal and the reception side time information which are output through the output processing, the receiving unit repeatedly executes the output processing at a preset synchronization signal output interval, and a length of the synchronization signal output interval is changeable.

According to the aspect of the invention with this configuration, even when the information acquisition unit fails to acquire the synchronization signal and the reception side time information which are output through the output processing, if acquisition of the synchronization signal and the reception side time information output is successful in the next and subsequent output processing, the time correction unit may correct the internal time.

As the synchronization signal output interval becomes longer, the average time period necessary for time correction becomes longer. Further, for example, as the success rate of acquisition of the synchronization signal performed by the information acquisition unit is lower, the average time becomes longer. The average value of the success rate of acquisition of the synchronization signal varies in accordance with the information processing capability of the information acquisition unit. According to the aspect of the invention with the configuration described above, for example, the length of the synchronization signal output interval can be set in accordance with the information processing capability of the information acquisition unit. Therefore, the average time period necessary for time correction may be appropriately adjusted.

It is preferable that the electronic device according to the aspect of the invention further includes an information acquisition unit that acquires the synchronization signal and the reception side time information, which are output through the output processing, and sends the synchronization signal and the reception side time information to the time correction unit, and the receiving unit outputs the synchronization signal during a preset synchronization signal output time period in the output processing, in a case where the information acquisition unit is unable to acquire the synchronization signal during the synchronization signal output time period, the time correction unit does not correct the internal time, and a length of the synchronization signal output time period is changeable.

As the time period (delay time period) from when the synchronization signal is output from the receiving unit to when it is detected by the information acquisition unit is longer, the error of the internal time after correction becomes larger. According to the aspect of the invention with the configuration described above, when the delay time period is long and the synchronization signal cannot be acquired within the synchronization signal output time period, the internal time is not corrected. Therefore, the maximum value of the delay time period for time correction, that is, the maximum value of the error of the internal time after correction can be determined on the basis of the length of the synchronization signal output time period.

The average value of the delay time period varies in accordance with the information processing capability of the information acquisition unit. According to the aspect of the invention, for example, the length of the synchronization signal output time period may be set in accordance with the information processing capability of the information acquisition unit. Therefore, the maximum value of the error of the internal time after correction may be appropriately adjusted.

A receiving device according to an aspect of the invention acquires time synchronization information and satellite time information by receiving a satellite signal, detects update timing of seconds on the basis of the time synchronization information, and executes output processing of outputting a synchronization signal, which indicates output timing, and reception side time information including time difference information, which indicates a time difference between the update timing of seconds and the output timing, and time information of hours, minutes, and seconds based on the satellite time information, before next update timing of seconds.

According to the aspect of the invention, after acquiring the time synchronization information and the satellite time information, the receiving device may output the time information of hours, minutes, and seconds on the basis of the synchronization signal, the time difference information, and the acquired satellite time information without waiting for the next update timing of seconds. Therefore, in a case where the time is corrected on the basis of the information which is output from the receiving device, as compared with a case where the receiving device waits for the next update timing of seconds and transmits the data, the time period necessary for the time correction may be shortened.

A receiving device according to an aspect of the invention acquires time synchronization information by receiving a satellite signal, detects update timing of seconds on the basis of the time synchronization information, and executes output processing of outputting a synchronization signal, which indicates output timing, and reception side time information including at least time difference information, which indicates a time difference between the update timing of seconds and the output timing, before the next update timing of seconds.

According to the aspect of the invention, after acquiring the time synchronization information and the satellite time information, the receiving device may output the synchronization signal and the time difference information without waiting for the next update timing of seconds. Therefore, in a case where the time is corrected on the basis of the information which is output from the receiving device, as compared with a case where the receiving device waits for the next update timing of seconds and transmits the data, the time period necessary for the time correction may be shortened.

If the receiving device acquires the time synchronization information, the time may be corrected without acquiring the satellite time information. Therefore, as compared with a case where the time correction is performed after the receiving device acquires the time synchronization information and the satellite time information, the time period necessary for time correction may be shortened.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, specific embodiments of the invention will be described with reference to the drawings.

First Embodiment

Figure 1:
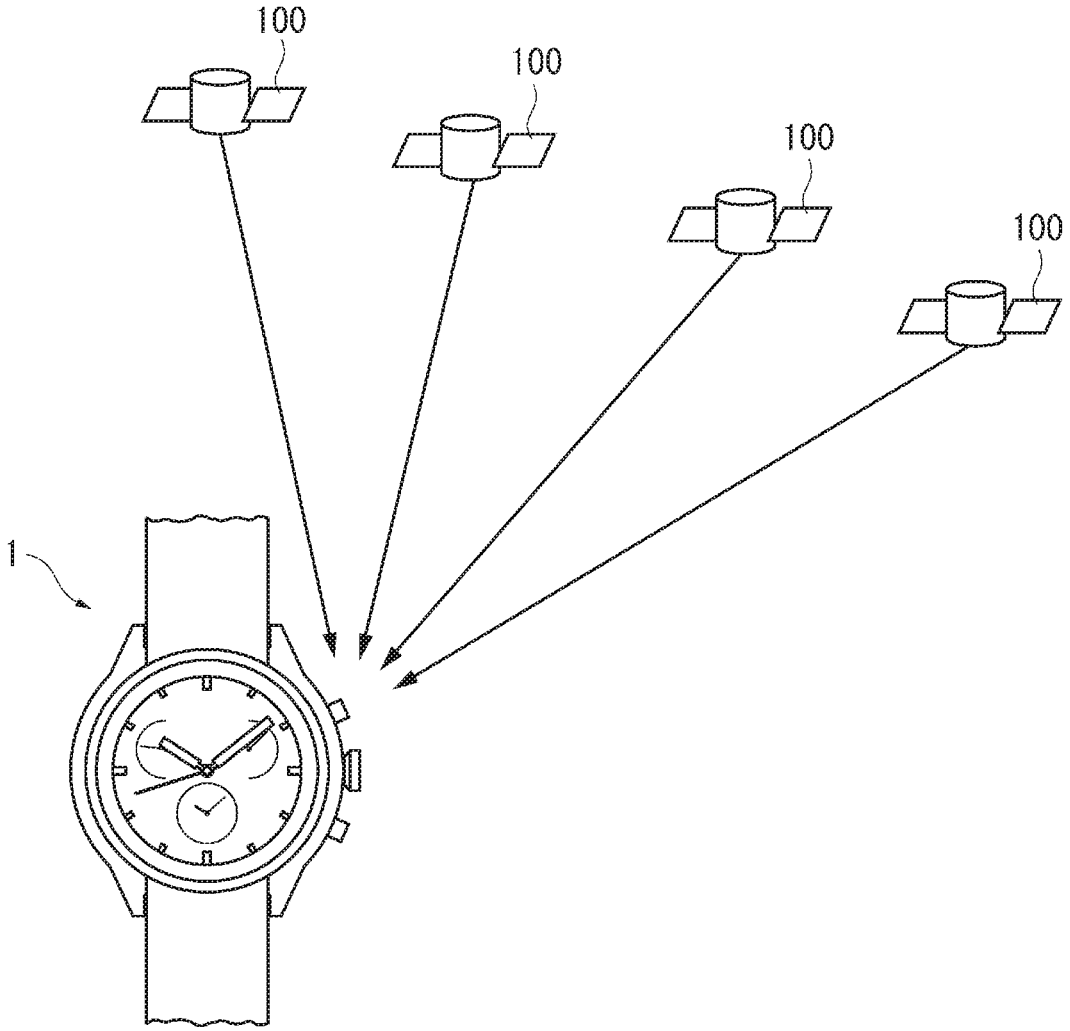
FIG. 1 is a schematic diagram of an electronic timepiece according to a first embodiment of the invention.

FIG. 1 is a schematic diagram illustrating an electronic timepiece 1 of the present embodiment.

An electronic timepiece 1 as an electronic device is configured to receive satellite signals from at least one GPS satellite 100 among a plurality of GPS satellites 100 circling around the earth along a predetermined orbit, acquire time information, and calculate and acquire position information by receiving the satellite signals from at least three GPS satellites 100. The GPS satellite 100 is an example of a position information satellite, and a plurality of GPS satellites 100 are present above the earth. About 30 GPS satellites 100 are now circling.

Schematic Configuration of Electronic Timepiece

Figure 2:
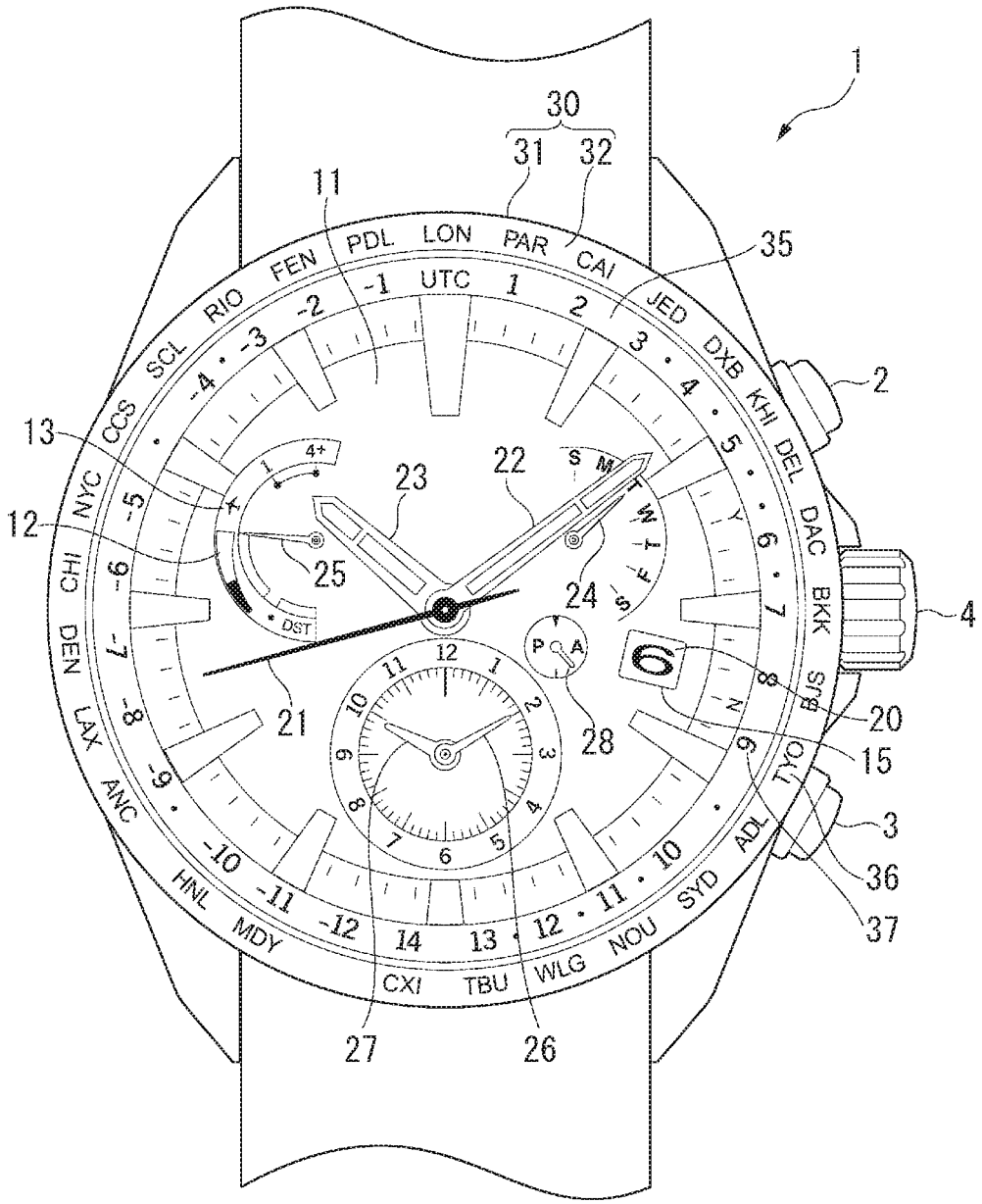
FIG. 2 is a plan view of the electronic timepiece according to the first embodiment.
Figure 3:
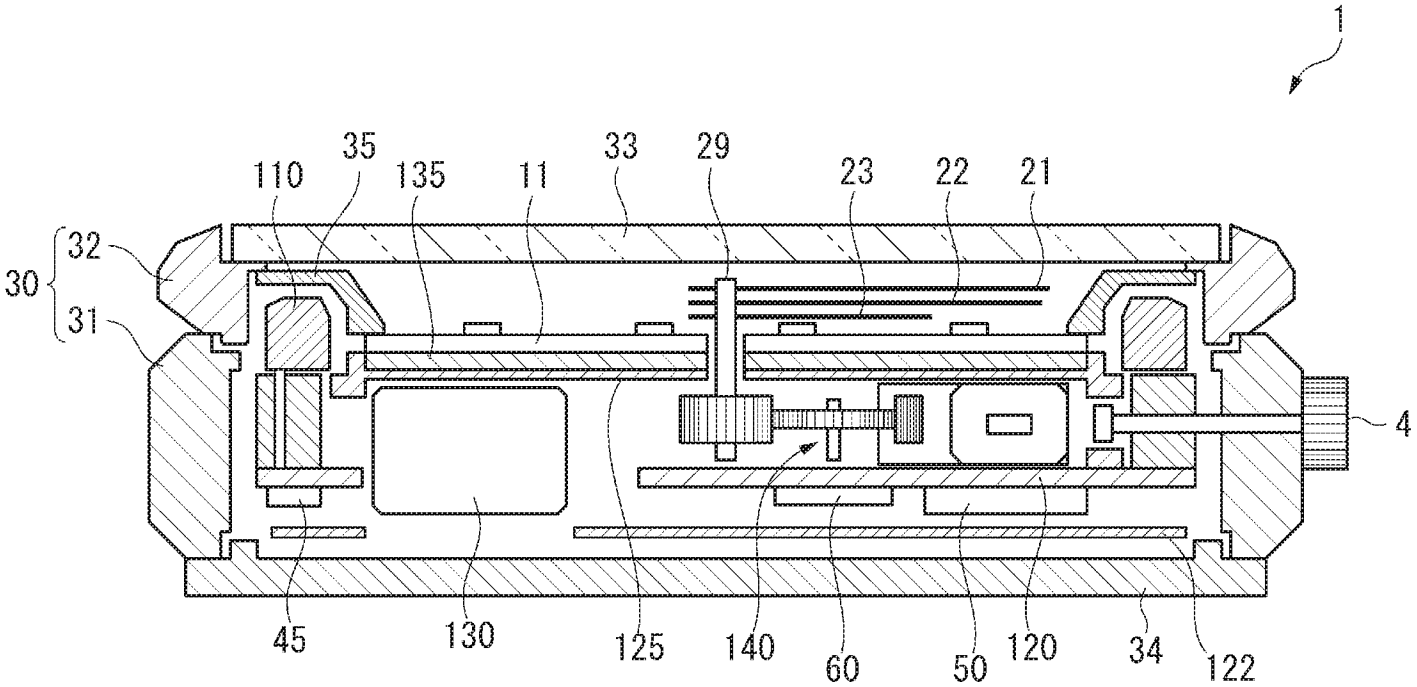
FIG. 3 is a cross-sectional view of the electronic timepiece according to the first embodiment.

FIG. 2 is a front view of the electronic timepiece 1, and FIG. 3 is a cross-sectional view schematically illustrating the electronic timepiece 1.

As shown in FIGS. 2 and 3, the electronic timepiece 1 includes an outer casing 30, a cover glass 33, and a back lid 34. The outer casing 30 is configured by fitting a bezel 32 formed of ceramic to a cylindrical casing 31 formed of metal. A disc-shaped dial plate 11 is disposed as a time display portion on the inner peripheral side of the bezel 32 in a state where a ring-shaped dial ring 35 formed of plastic is interposed therebetween.

On the side surface of the outer casing 30, an A button 2 is provided at a position in the direction of 2 o'clock from the center of the dial plate 11, a B button 3 is provided at a position in the direction of 4 o'clock, and a crown 4 is provided at a position in the direction of 3 o'clock.

As shown in FIG. 3, in the electronic timepiece 1, a front side opening of two openings of the metallic casing 31 is covered by the cover glass 33 with the bezel 32 interposed therebetween, and a back side opening is covered by the back lid 34 formed of metal.

The dial ring 35 attached to the inner periphery of the bezel 32, the light transmissive dial plate 11, watch hands 21 to 28, a calendar wheel 20, a driving mechanism 140 that drives the watch hands 21 to 28, and the calendar wheel 20, and the like are provided inside the outer casing 30.

The dial ring 35 has a flat plate portion whose outer peripheral portion is in contact with the bezel 32 and whose one side is parallel to the cover glass 33, and an inclined portion that is inclined toward the dial plate 11 so that an inner peripheral portion of the inclined portion is in contact with the dial plate 11. The dial ring 35 has a ring shape in a plan view and a mortar shape in a cross-sectional view. The flat plate portion of the dial ring 35, the inclined portion thereof, and the inner circumferential surface of the bezel 32 form a donut-shaped storage space. In the storage space, a ring-shaped antenna body 110 is housed.

The dial plate 11 is a circular plate member displaying the time inside the outer casing 30, is formed of a light transmissive material such as plastic, is provided with the watch hands 21 to 28 and the like between the dial plate 11 and the cover glass 33, and is disposed inside the dial ring 35.

A solar cell 135 for photovoltaic generation is provided between the dial plate 11 and a base plate 125 to which the driving mechanism 140 is attached. The solar cell 135 is a circular flat plate in which a plurality of photovoltaic elements which convert light energy into electric energy are connected in series. Holes, through which the watch hand shaft 29 of the watch hands 21 to 23 and the watch hand shaft (not shown) of the watch hands 24 to 28 pass, are formed in the dial plate 11 and the solar cell 135. Openings for a small calendar window 15 are formed in the dial plate 11 and the solar cell 135.

The driving mechanism 140 is attached to the base plate 125, and is covered from the back side with a circuit board 120. The driving mechanism 140 has a stepping motor and a gear train such as a gear, and the stepping motor drives the watch hands by rotating the watch hand shaft 29 and the like through the gear train.

Specifically, the driving mechanism 140 includes first to sixth driving mechanisms. The first driving mechanism drives the watch hand 22 and the watch hand 23, the second driving mechanism drives the watch hand 21, the third driving mechanism drives the watch hand 24, the fourth driving mechanism drives the watch hand 25, the fifth driving mechanism drives the watch hands 26 to 28, and the sixth driving mechanism drives the calendar wheel 20.

The circuit board 120 includes a GPS receiving circuit 45, a control circuit 50, and a storage device 60.

In addition, the circuit board 120 and the antenna body 110 are connected by using antenna connection pins. A circuit holding member 122, which covers these circuit components, is provided on the back lid 34 side of the circuit board 120 on which the GPS receiving circuit 45, the control circuit 50, and the storage device 60 are provided. A secondary battery 130 such as a lithium ion battery is provided between the base plate 125 and the back lid 34. The secondary battery 130 is charged with electric power generated by the solar cell 135.

Display Mechanism of Electronic Timepiece

As shown in FIG. 2, graduations for dividing the inner periphery into 60 divisions are noted on the inner peripheral side of the dial ring 35 surrounding the outer peripheral portion of the dial plate 11. Using the graduations, the watch hand 21 displays "second" at the first time at the normal time, the watch hand 22 displays "minute" at the first time, and the watch hand 23 displays "hour" at the first time. Since the "second" at the first time is the same as the "second" at the second time described later, a user is also able to grasp the "second" at the second time by checking the watch hand 21.

In the dial ring 35, an alphabetical letter "Y" is noted at the position of 12 minutes, and an alphabetical letter "N" is noted at the position of 18 minutes. This alphabetical letter represents the reception (acquisition) result (Y: reception (acquisition) success, N: reception (acquisition) failure) of various information pieces on the basis of the satellite signal received from the GPS satellite 100. The watch hand 21 indicates either "Y" or "N", and displays the reception result of the satellite signal. The display of the reception result is performed by pressing the A button 2 for less than 3 seconds.

The watch hand 24 is provided at a position in the direction of 2 o'clock from the center of the dial plate 11. Alphabetical letters of "S", "M", "T", "W", "T", "F", and "S" indicating the seven days are noted on the outer periphery of the rotation area of the watch hand 24. The watch hand 24 displays the day of the week by designating one of "S" to "S".

The watch hand 25 is provided at a position in the direction of 10 o'clock from the center of the dial plate 11. Hereinafter, the notation of the outer periphery of the rotation area of the watch hand 25 will be described, but the "direction of n o'clock" (n is any natural number) is the direction when the outer periphery of the rotation area is viewed from the watch hand shaft of the watch hand 25.

Alphabetical letters of "DST" and a sign "o" are noted on the outer periphery of the range from the direction of 6 o'clock to the direction of 7 o'clock of the rotation area of the watch hand 25. The DST means daylight saving time. The watch hand 25 displays the setting of daylight saving time (DST: daylight saving time ON, o: daylight saving time OFF) by designating these alphabetical letters and signs.

A crescent moon shaped sign 12, of which the tip in the direction of 8 o'clock is thin and the base end in the direction of 9 o'clock is thick, is noted on the outer periphery of the range from the direction of 8 o'clock to the direction of 9 o'clock of the rotation area of the watch hand 25. This sign 12 is a power indicator of the secondary battery 130 (refer to FIG. 3), and the remaining battery level is displayed by causing the watch hand 25 to indicate a position corresponding to the remaining battery level. It should be noted that the watch hand 25 indicates the sign 12 at the normal time.

An airplane shaped sign 13 is noted on the outer periphery of the rotation area of the watch hand 25 in the direction of 10 o'clock. This sign represents the airplane mode. At the time of aircraft take-off and landing, reception of satellite signals is prohibited by the aeronautical law. The watch hand 25 is set to the airplane mode by indicating the sign 13, and indicates that reception is not performed.

The numeral "1" and sign "4+" are noted on the outer periphery of the range from the direction of 11 o'clock to the direction of 12 o'clock of the rotation area of the watch hand 25. These numeral and sign represent the reception mode of the satellite signal. "1" means that the time information is received and the internal time is corrected (time measurement mode), "4+" means that the time information and orbit information are received, the position information of the current position is calculated, and the internal time and the time zone data to be described later are corrected (position measurement mode).

The hands 26 and 27 are provided at a position in the direction of 6 o'clock from the center of the dial plate 11. The watch hand 26 displays "minute" at the second time, and the watch hand 27 displays "hour" at the second time.

The watch hand 28 is provided at a position in the direction of 4 o'clock from the center of the dial plate 11, and displays the morning or afternoon at the second time.

The small calendar window 15 is provided in an opening portion through which the dial plate 11 is opened in a rectangular shape, and the numeral printed on the calendar wheel 20 is visible through the opening portion. This numeral represents "day" of the year, month, and day at the first time.

Time difference information 37, which indicates the time difference from the coordinated universal time (UTC) along the graduations on the inner periphery side, is noted with numerals and signs other than numerals on the dial ring 35. The time difference information 37 of the numeral is an integer time difference, and the time difference information 37 of the sign indicates that the time difference is other than an integer. The time difference between the first time indicated by the watch hands 21 to 23 and UTC can be checked on the basis of the time difference information 37 indicated by the watch hand 21 by pressing the B button 3.

City information 36, which represents the representative city name of the time zone using the standard time corresponding to the time difference of the time difference information 37 noted on the dial ring 35, is also noted in the time difference information 37 on the bezel 32 provided around the dial ring 35.

Circuit Configuration of Electronic Timepiece

Figure 4:
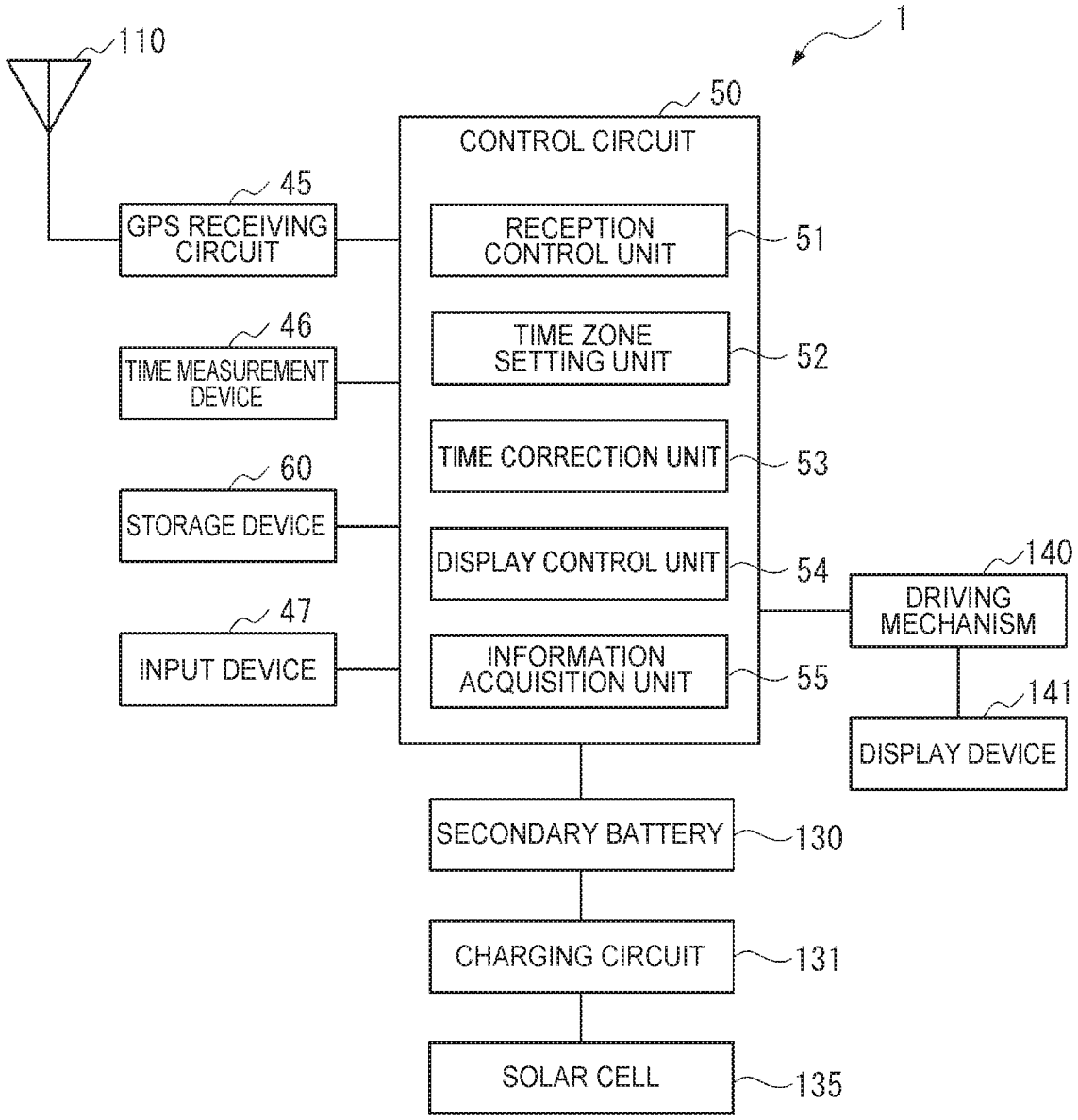
FIG. 4 is a block diagram illustrating a circuit configuration of the electronic timepiece according to the first embodiment.

FIG. 4 is a block diagram illustrating a circuit configuration of the electronic timepiece 1. As shown in the drawing, the electronic timepiece 1 includes the solar cell 135, a charging circuit 131, the secondary battery 130, the GPS receiving circuit 45, a time measurement device 46, the storage device 60, an input device 47, the control circuit 50, the driving mechanism 140, and a display device 141.

The charging circuit 131 supplies electric power generated by the solar cell 135 to the secondary battery 130, and charges the secondary battery 130.

The GPS receiving circuit 45 as a satellite signal receiving device is connected to the antenna body 110, and processes satellite signals received through the antenna body 110, thereby acquiring time information and position information.

It should be noted that the details of the GPS receiving circuit 45 will be described later.

The input device 47 includes the A button 2, the B button 3, and the crown 4 shown in FIG. 2, detects an operation instructing execution, on the basis of pushing and releasing the respective buttons 2 and 3 and pulling out, pushing in, and rotating the crown 4, and outputs an operation signal corresponding to the detected operation to the control circuit 50.

The display device 141 includes the dial plate 11, the dial ring 35, the bezel 32, the watch hands 21 to 28, and the calendar wheel 20 shown in FIG. 2.

Figure 5:
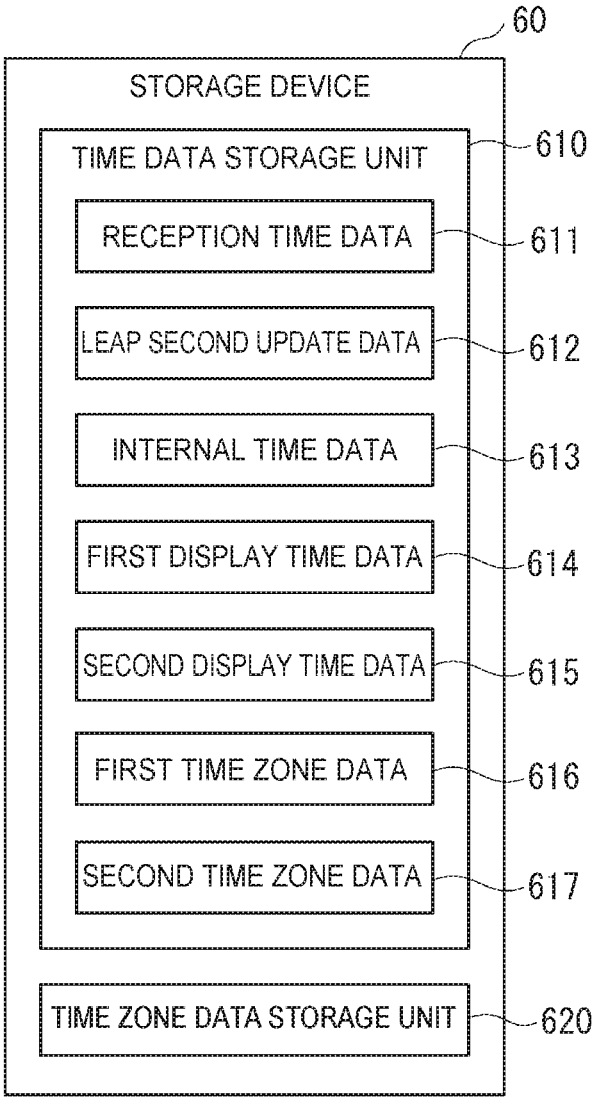
FIG. 5 is a diagram illustrating a data structure of a storage device according to the first embodiment.

The storage device 60 is constituted by a random access memory (RAM) or a read only memory (ROM). As shown in FIG. 5, the storage device 60 includes a time data storage unit 610 and a time zone data storage unit 620.

The time data storage unit 610 stores reception time data 611, leap second update data 612, internal time data 613, first display time data 614, second display time data 615, first time zone data 616, and second time zone data 617.

In the reception time data 611, the time information (GPS time) acquired from the satellite signal is stored. Normally, the time measurement device 46 updates the reception time data 611 every 1 second, and the acquired time information (GPS time) is stored when the satellite signal is received.

At least the data of the current leap second is stored in the leap second update data 612. That is, the sub-frame 4 and page 18 of the satellite signal include, as data on leap seconds, "current leap second", "week of update of leap seconds", "date of update of leap seconds", and "leap seconds after update". In the present embodiment, among them, at least data of the "current leap second" is stored in the leap second update data 612.

In the internal time data 613, the internal time information is stored. This internal time information is updated by the GPS time stored in the reception time data 611 and the "current leap second" stored in the leap second update data 612. That is, the coordinated universal time (UTC) is stored in the internal time data 613. When the time measurement device 46 updates the reception time data 611, this internal time information is also updated.

In the first display time data 614, the time information obtained by adding the time zone data (time difference information) of the first time zone data 616 to the internal time information of the internal time data 613 is stored. The first time zone data 616 is set on the basis of time zone data obtained when a user manually selects or receives data in the position measurement mode. Here, the time information of the first display time data 614 corresponds to the first time displayed by the watch hands 21 to 23.

In the second display time data 615, the time information obtained by adding the time zone data of the second time zone data 617 to the internal time information of the internal time data 613 is stored. The second time zone data 617 is set on the basis of the time zone data obtained when a user manually selects. Here, the time information of the second display time data 615 corresponds to the second time displayed by the watch hands 21 and 26 to 28.

The time zone data storage unit 620 stores position information and time zone data (time difference information) in association with each other. Therefore, when the position information is acquired in the position measurement mode, the control circuit 50 is able to acquire the time zone data on the basis of the position information.

The time zone data storage unit 620 further stores the city name and the time zone data in association with each other. Therefore, when a user selects a city name whose local time the user wants to know by operating the crown 4, the control circuit 50 searches the time zone data storage unit 620 for the city name which is set by the user, acquires time zone data corresponding to the city name, and sets the time zone data as the first time zone data 616 or the second time zone data 617.

The time measurement device 46 includes a second measurement timer for measuring 1 second by using the clock signal of the crystal oscillator. The time measurement device 46 updates the internal time information of the internal time data 613 whenever the second measurement timer measures 1 second.

That is, the year, month, day, hour, minute, and second in the internal time of the electronic timepiece 1 is determined by the internal time information of the internal time data 613, and the time of less than a second in the internal time is determined by the measurement value of the second measurement timer.

Returning to FIG. 4, the control circuit 50 is constituted by a CPU that controls the electronic timepiece 1. The control circuit 50 functions as a reception control unit 51, a time zone setting unit 52, a time correction unit 53, a display control unit 54, and an information acquisition unit 55 by executing various programs stored in the storage device 60.

When the automatic reception condition that is a condition for executing reception is satisfied, the reception control unit 51 executes receiving processing in the time measurement mode by operating the GPS receiving circuit 45. For example, when a preset time is satisfied, the reception control unit 51 determines that the automatic reception condition is satisfied. Further, when it is determined that the generated voltage or the generated current of the solar cell 135 is equal to or greater than the set value and the solar cell 135 is irradiated with sunlight outdoors, it is determined that the automatic reception condition is satisfied.

When the reception control unit 51 detects that the A button 2 is pressed for 3 seconds or more and less than 6 seconds on the basis of the operation signal which is output from the input device 47, the reception control unit 51 executes the receiving processing in the time measurement mode by operating the GPS receiving circuit 45. When it is detected that the A button 2 is pressed for 6 seconds or more, the receiving processing in the position measurement mode is executed by operating the GPS receiving circuit 45.

When the receiving processing in the time measurement mode is executed, the GPS receiving circuit 45 captures at least one GPS satellite 100, receives the satellite signal transmitted from the GPS satellite 100, and acquires the time information.

When the receiving processing in the position measurement mode is executed, the GPS receiving circuit 45 captures at least three, preferably four or more GPS satellites 100, receives the satellite signals transmitted from the respective GPS satellites 100, and calculates and acquires position information. Further, the GPS receiving circuit 45 is able to simultaneously acquire the time information when receiving the satellite signal.

When the acquisition of the position information is successful in the receiving processing in the position measurement mode, the time zone setting unit 52 sets the time zone data on the basis of the acquired position information. Specifically, time zone data corresponding to the position information is selected and acquired from the time zone data storage unit 620, and stored in the first time zone data 616.

For example, the Japan standard time (JST) is the time (UTC+9) advanced by 9 hours relative to UTC. Therefore, when the acquired position information is Japan, the time zone setting unit 52 reads time difference information (+9 hours) of the Japan standard time from the time zone data storage unit 620, and stores the information in the first time zone data 616.

When either the time difference information 37 or the city information 36 is selected through the operation of the input device 47, the time zone setting unit 52 stores the time zone data, which corresponds to the selected time difference information 37 or the city information 36, in the first time zone data 616 or the second time zone data 617.

When the time information is successfully acquired by the receiving processing in the time measurement mode or the position measurement mode, the time correction unit 53 stores the acquired time information in the reception time data 611. Thereby, the internal time data 613, the first display time data 614, and the second display time data 615 are corrected.

The time correction unit 53 corrects the first display time data 614 by using the first time zone data 616, and corrects the second display time data 615 by using the second time zone data 617. Therefore, the first display time data 614 and the second display time data 615 are times obtained when the respective time zone data pieces are added to the internal time data 613 which is UTC.

The time correction unit 53 corrects the time of less than a second in the internal time by resetting the second measurement timer.

The display control unit 54 controls the driving mechanism 140 such that the watch hands 21 to 23 and the calendar wheel 20 displays the time information of the first display time data 614, and controls the driving mechanism 140 such that the watch hands 26 to 28 displays the time information of the second display time data 615.

The information acquisition unit 55 acquires the synchronization signal and information which are output from the GPS receiving circuit 45, and delivers them to each of the functional units 51 to 55.

Navigation Message

Here, a navigation message, which is a satellite signal transmitted from the GPS satellite 100, will be described. The navigation message is modulated as satellite radio waves as data of 50 bps.

Figure 6:
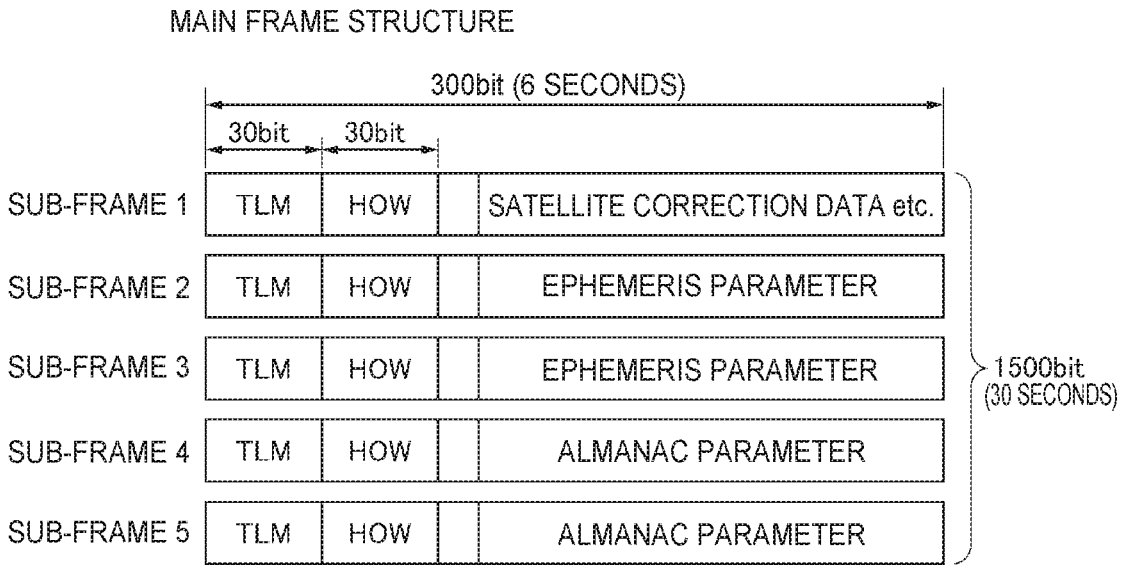
FIG. 6 is a diagram illustrating a main frame configuration of a navigation message of a GPS satellite signal.
Figure 7:
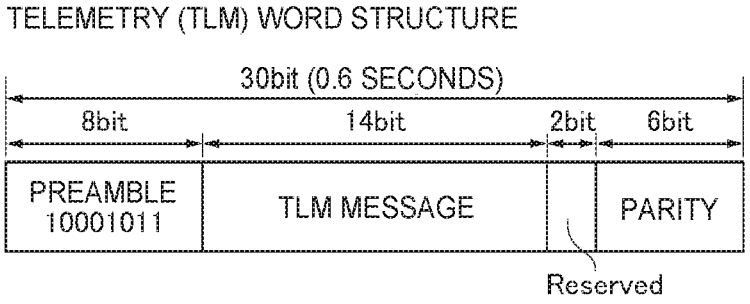
FIG. 7 is a diagram illustrating a TLM word structure of a navigation message of a GPS satellite signal.
Figure 8:
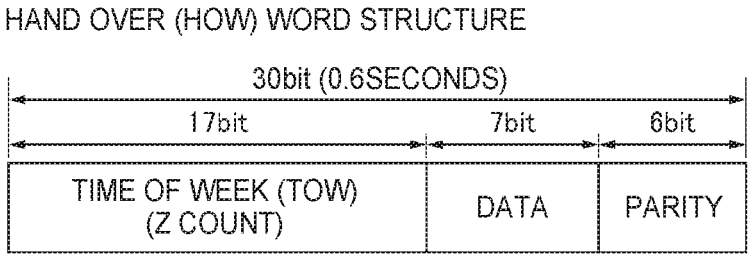
FIG. 8 is a diagram illustrating a HOW word configuration of a navigation message of a GPS satellite signal.

FIGS. 6 to 8 are diagrams for explaining the configuration of the navigation message.

As shown in FIG. 6, the navigation message is configured as data of which a main frame having a total of 1500 bits is set as one unit. The mainframe is divided into five sub-frames 1 to 5 each having 300 bits. Data of one sub-frame is transmitted from each GPS satellite 100 in 6 seconds. Therefore, data of one main frame is transmitted from each GPS satellite 100 in 30 seconds.

The sub-frame 1 includes week number data (WN: week number) and satellite correction data.

The week number data is information representing a week including the current GPS time information, and is updated in units of one week.

The sub-frames 2 and 3 include ephemeris parameters (detailed orbit information of each GPS satellite 100). Further, the sub-frames 4 and 5 include almanac parameters (rough orbit information of all GPS satellites 100).

The sub-frames 1 to 5 include, in order from the head, a TLM word (also referred to as a word 1) storing 30-bit telemetry word (TLM) data, and a HOW word (also referred to as a word 2) storing a 30-bit hand-over word (HOW) data.

Therefore, the TLM word and the HOW word are transmitted from the GPS satellite 100 at intervals of 6 seconds, whereas week number data, satellite correction data, ephemeris parameters, and almanac parameters are transmitted at intervals of 30 seconds.

The TLM word includes time synchronization information indicating time synchronization timing. Specifically, as shown in FIG. 7, the TLM word includes preamble data, a TLM message, reserved bits, and parity data.

As shown in FIG. 8, the HOW word includes GPS time information (satellite time information) of TOW (Time of Week, also referred to as a "Z count"). The Z count data is displayed in seconds elapsed from 0 o'clock at every Sunday, and is set to return to 0 at 0 o'clock at the next Sunday. That is, the Z count data is information in which a time period is represented in units of seconds every week from the beginning of the week. This Z count data indicates a time at which the first bit of the next sub-frame data is transmitted.

Therefore, the electronic timepiece 1 is able to acquire the date information and the time information by acquiring the week number data included in the sub-frame 1 and the TLM word and the HOW word (Z count data) included in the sub-frames 1 to 5. However, if the electronic timepiece 1 previously acquired the week number data and internally counted the elapsed time period from the time at which the week number data was acquired, the electronic timepiece 1 is able to acquire the current week number data of the GPS satellite 100 regardless of acquisition of the week number data.

Therefore, the electronic timepiece 1 may acquire the week number data of the sub-frame 1 only when the week number data (date information) is not stored internally, as in the time after reset or the time of power-on. Then, in a case where the week number data is stored, the electronic timepiece 1 is able to acquire the current time when acquiring the TLM word and the HOW word.

Configuration of GPS Receiving Circuit

Figure 9:
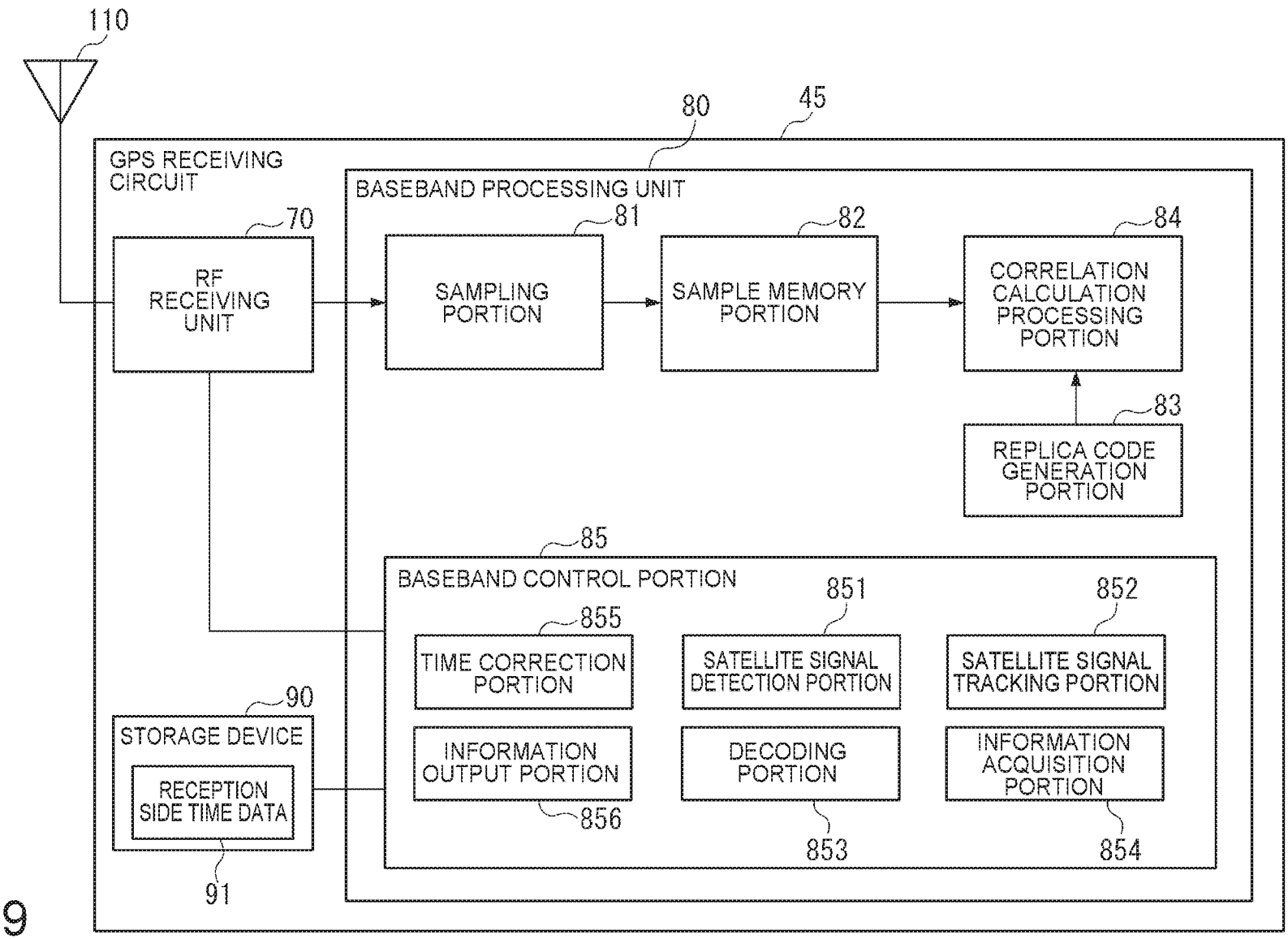
FIG. 9 is a block diagram illustrating a GPS receiving circuit according to the first embodiment.
Figure 10:
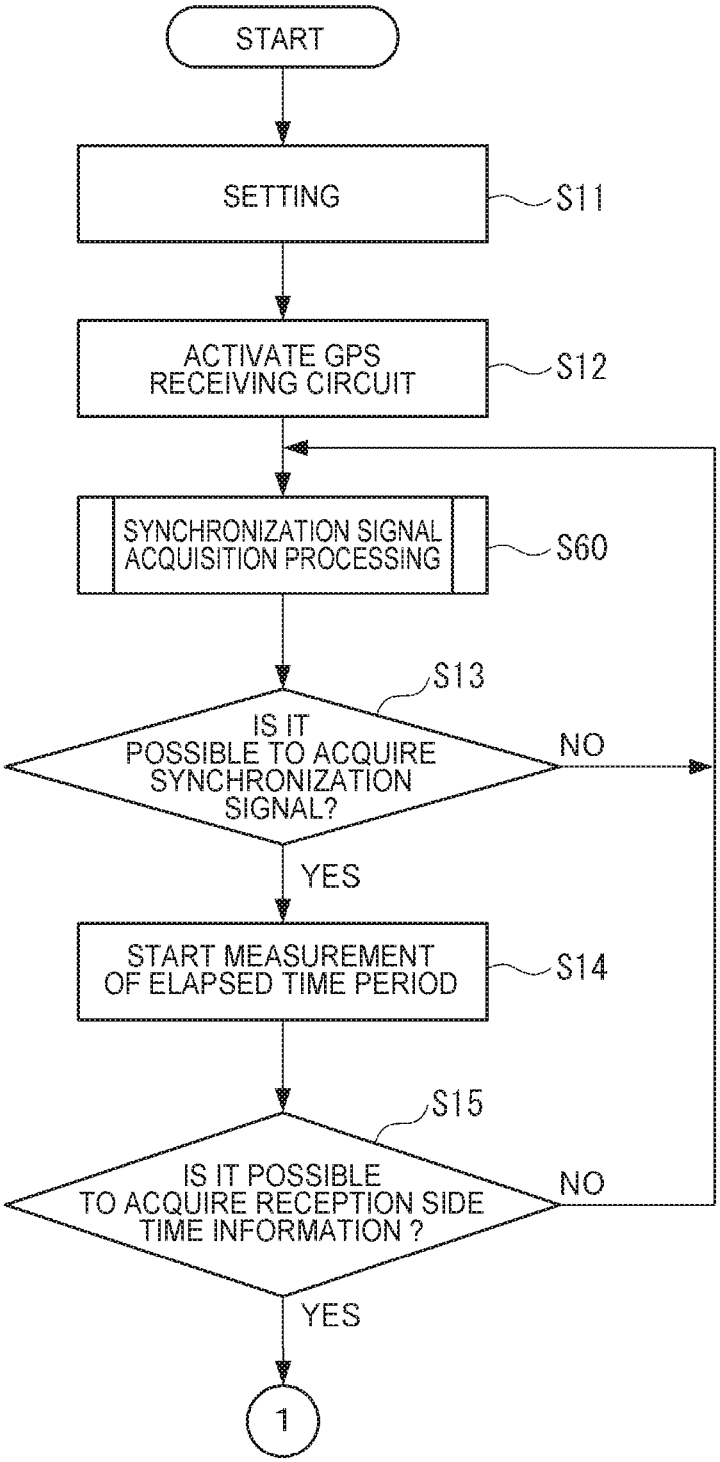
FIG. 10 is a flowchart illustrating time correction processing in the first embodiment.
Figure 11:
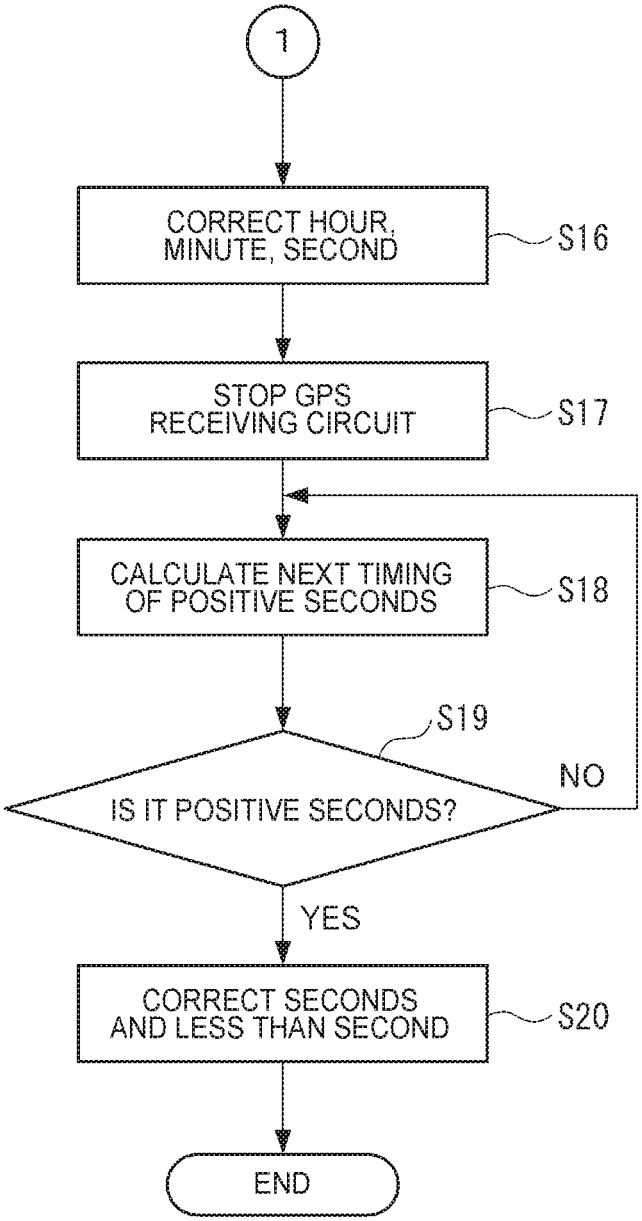
FIG. 11 is a flowchart illustrating time correction processing in the first embodiment.

FIG. 9 is a block diagram illustrating a circuit configuration of the GPS receiving circuit 45.

As shown in FIG. 9, the GPS receiving circuit 45 as a receiving unit (receiving device) includes an RF receiving unit 70, a baseband processing unit 80, and a storage device 90.

RF Receiving Unit

The RF receiving unit 70 receives the radio waves in the frequency band of the satellite signal using the antenna body 110, and outputs the received signal. Specifically, the RF receiving unit 70 includes an amplifying circuit (LNA) which amplifies the received signal, a band pass filter (BPF) which removes signal components other than the frequency band of the satellite signal from the received signal, and a mixer circuit which converts the received signal into a signal in the intermediate frequency band by mixing local oscillation signals.

Baseband Processing Unit

The baseband processing unit 80 includes a sampling portion 81, a sample memory portion 82, a replica code generation portion 83, a correlation calculation processing portion 84, and a baseband control portion 85.

The sampling portion 81 includes an analog-to-digital converter (ADC) and the like, converts the received signal which is output from the RF receiving unit 70 into a digital signal at a predetermined sampling period, and outputs the digital signal.

In the sample memory portion 82, the received signal, which is output from the sampling portion 81, is accumulated.

The replica code generation portion 83 generates a replica of the PRN code (C/A code) corresponding to the GPS satellite 100 specified by the baseband control portion 85.

The correlation calculation processing portion 84 executes correlation processing of calculating a correlation value between the received signal stored in the sample memory portion 82 and the replica code (also referred to as a code) generated by the replica code generation portion 83.

The baseband control portion 85 includes a satellite signal detection portion 851, a satellite signal tracking portion 852, a decoding portion 853, an information acquisition portion 854, a time correction portion 855, and an information output portion 856.

The satellite signal detection portion 851 controls the RF receiving unit 70, the sampling portion 81, and the sample memory portion 82 such that those receive radio waves and store the received signal in the sample memory portion 82.

Further, the replica code generation portion 83 and the correlation calculation processing portion 84 are controlled to generate a replica code, calculate the correlation value between the received signal stored in the sample memory portion 82 and the replica code, and execute detection processing of detecting the satellite signal.

The satellite signal tracking portion 852 controls the RF receiving unit 70, the sampling portion 81, the sample memory portion 82, the replica code generation portion 83, and the correlation calculation processing portion 84 so as to perform the following processing. That is, radio waves are received, and the received signal is stored in the sample memory portion 82. Then, a replica code is generated, a correlation value between the received signal stored in the sample memory portion 82 and the replica code is calculated, and tracking processing (tracking) of tracking the satellite signal detected by the detection processing is executed.

The decoding portion 853 decodes the tracked satellite signal.

The information acquisition portion 854 acquires the time synchronization information and the GPS time information on the basis of the decoded data. The position information is calculated and acquired on the basis of the data.

The time correction portion 855 detects the timing of positive seconds (the update timing of seconds) of the correct time (satellite transmission time), on the basis of the time synchronization information acquired by the information acquisition portion 854. Then, reception side time data 91 of the storage device 90 is corrected, on the basis of the detected timing of positive seconds and the GPS time information acquired by the information acquisition portion 854. The reception side time information, which includes the current time information of at least hours, minutes, and seconds and less than a second, is stored in the reception side time data 91. The reception side time information is updated by a timing unit (not shown) included in the GPS receiving circuit 45.

When the reception side time data 91 is corrected by the receiving processing, the information output portion 856 executes output processing of outputting the synchronization signal, which indicates the output timing, and the reception side time information at the output timing to the control circuit 50. The synchronization signal is output as a pulse signal from a first output terminal of the GPS receiving circuit 45, and is input to the control circuit 50 through a first signal line. The reception side time information is output from a second output terminal different from the first output terminal, and is input to the control circuit 50 through a second signal line different from the first signal line.

Time Correction Processing

Next, time correction processing executed by the electronic timepiece 1 will be described with reference to the flowcharts of FIGS. 10 to 15.

When the A button 2 is pressed for 3 seconds or more and less than 6 seconds so as to perform the forcible reception operation in the time measurement mode, or when the automatic reception condition is satisfied, the control circuit 50 starts the time correction processing.

When the time correction processing is started, the control circuit 50 sets the correction mode, the synchronization signal output time period, and the synchronization signal output interval as a preset mode, a preset time, and a preset interval (S11).

The correction mode includes a positive second synchronous mode for correcting the internal time of the internal time data 613, at the timing of positive seconds, and a positive second asynchronous mode for correcting the internal time before the next timing of positive seconds after the GPS receiving circuit 45 receives the satellite signal and acquires the time synchronization information and the satellite time information.

Next, the reception control unit 51 activates the GPS receiving circuit 45 (S12), and gives an instruction to execute the receiving processing at the set correction mode, the set synchronization signal output time period, and the set synchronization signal output interval.

Figure 12:
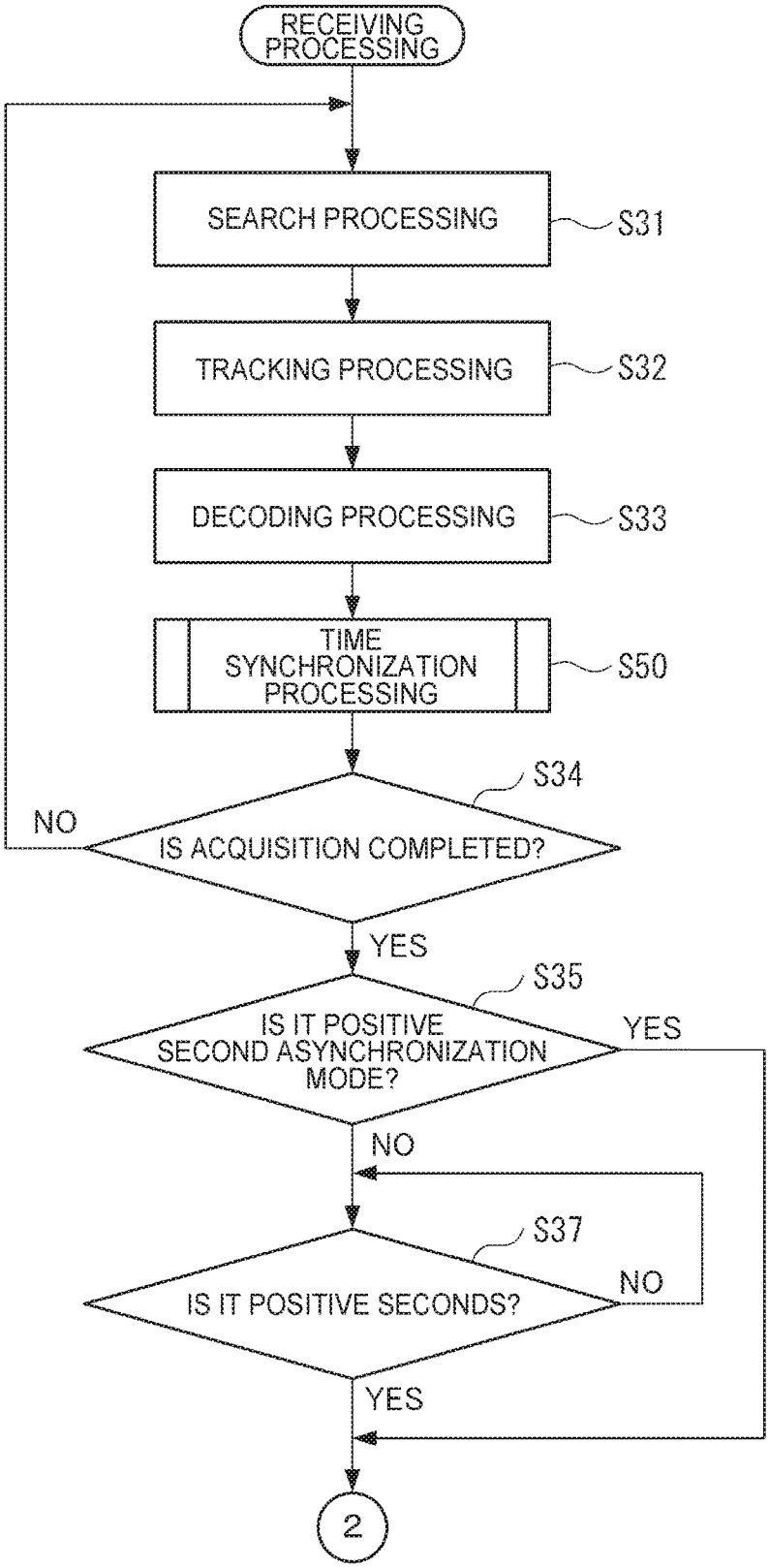
FIG. 12 is a flowchart illustrating receiving processing in the first embodiment.
Figure 13:
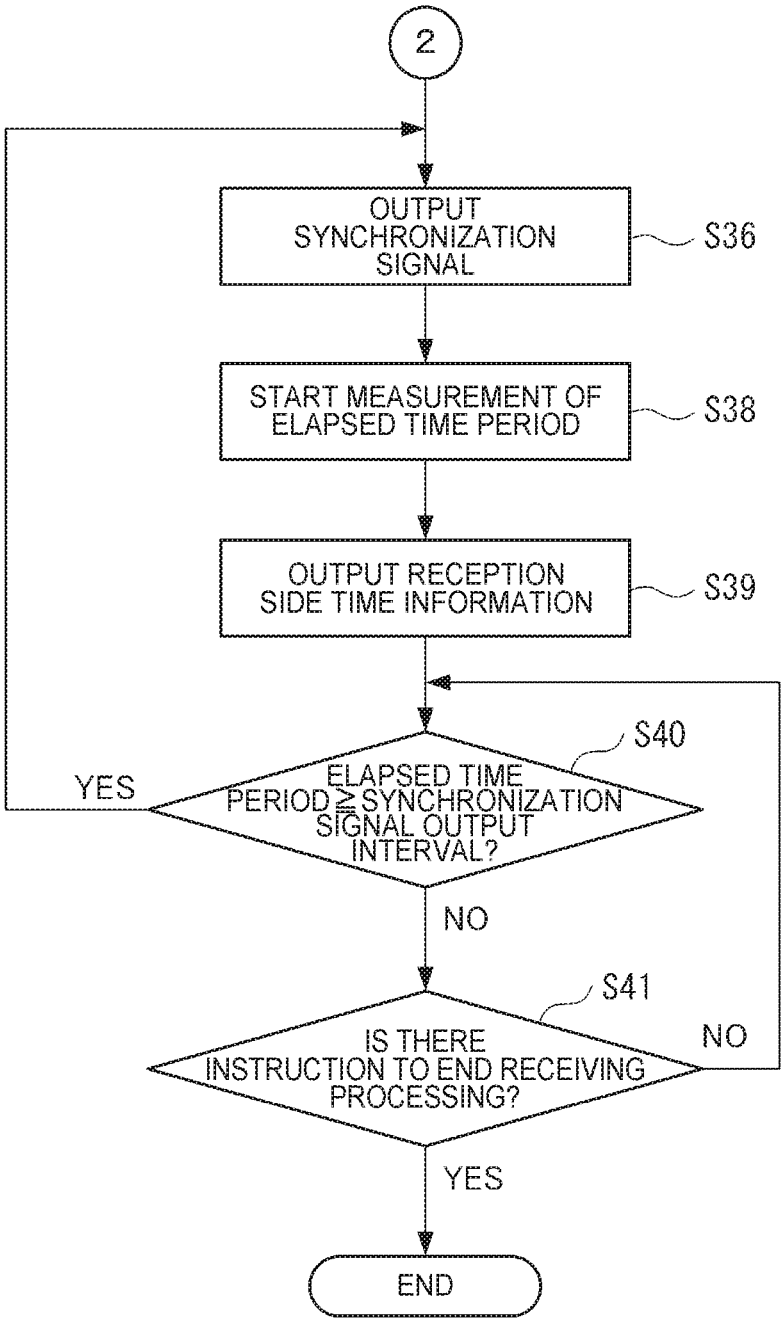
FIG. 13 is a flowchart illustrating receiving processing in the first embodiment.

Thereby, the GPS receiving circuit 45 starts the receiving processing. When the receiving processing is started, as shown in FIGS. 12 and 13, the baseband control portion 85 searches the GPS satellite 100 through the satellite signal detection portion 851 (S31). Then, the satellite signal tracking portion 852 tracks at least one captured GPS satellite 100, and acquires a navigation message (S32). Then, the decoding portion 853 demodulates the navigation message, and the information acquisition portion 854 executes decoding processing of acquiring the time synchronization information and the GPS time information included in the navigation message (S33).

Next, the baseband control portion 85 executes a time synchronization processing S50 of correcting the reception side time data 91.

Figure 14:
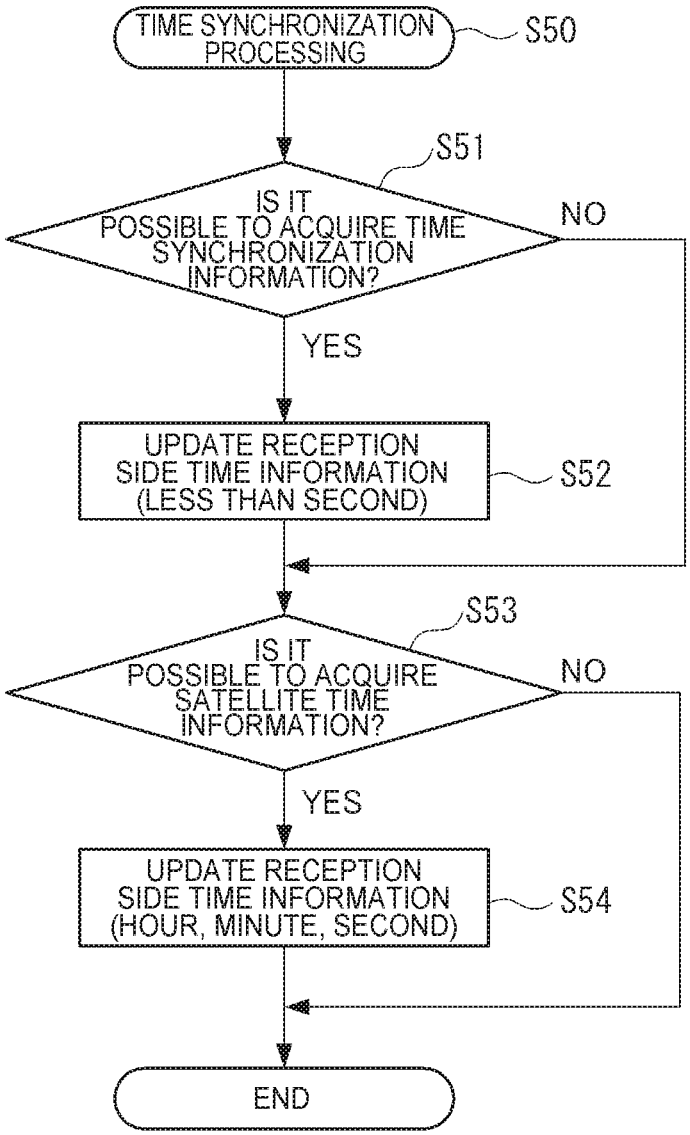
FIG. 14 is a flowchart illustrating time synchronization processing in the first embodiment.

When the time synchronizing processing S50 is executed, as shown in FIG. 14, the time correction portion 855 determines whether or not the time synchronization information can be acquired (S51).

If the determination is YES in S51, the time correction portion 855 detects the timing of positive seconds on the basis of the time synchronization information. Then, a time of less than a second is acquired, and the time of less than a second in the reception side time data 91 is corrected (updated) (S52).

After the processing in S52 or if the determination is NO in S51, the time correction portion 855 determines whether or not GPS time information (satellite time information) can be acquired (S53).

If the determination is YES in S53, the time correction portion 855 updates the hours, minutes, and seconds in the reception side time data 91 on the basis of the GPS time information (S54).

After the processing of S53 or if the determination is NO in S53, the time correction portion 855 ends the time synchronization processing S50.

Returning to FIG. 12, after the time synchronization processing S50 is completed, the baseband control portion 85 determines whether or not acquisition of time synchronization information and GPS time information is completed (S34). If the determination is NO in S34, the baseband control portion 85 returns the processing to S31, and searches the GPS satellite 100 again. As a result, each processing of S31 to S33, S50 and S34 is repeatedly executed until the time synchronization information and the GPS time information can be obtained or until the timeout occurs.

Next, the information output portion 856 determines whether or not the set correction mode is the positive second asynchronization mode (S35).

When the positive second asynchronization mode is set, the information output portion 856 makes a determination of YES in S35, and outputs a synchronization signal, which indicates the output timing, to the control circuit 50 during the set synchronization signal output time period (S36). The synchronization signal is an H level signal of H and L level signals. That is, the synchronization signal is output before the next timing of positive seconds. Then, the information output portion 856 acquires the reception side time information (information of hours, minutes, and seconds, and information of the time of less than a second) of the reception side time data 91 at the time of outputting the synchronization signal.

On the other hand, if the positive second synchronization mode is set, the information output portion 856 makes a determination of NO in S35, and determines whether or not it is the next timing of positive seconds (S37). The information output portion 856 repeatedly executes the processing of S37 until the positive second timing of seconds is reached. Then, at the next timing of positive seconds, the information output portion 856 makes a determination of YES in S37, and outputs a synchronization signal to the control circuit 50 in S36. Then, the information output portion 856 acquires the reception side time information of the reception side time data 91 at the time of outputting the synchronization signal.

After the synchronization signal is output in S36, the information output portion 856 starts measurement of the elapsed time from outputting of the synchronization signal (S38).

Next, the information output portion 856 outputs the reception side time information (information of hours, minutes, and seconds, and information of the time of less than a second) at the time of outputting the synchronization signal to the control circuit 50 (S39). Here, the information of the time of less than a second in the reception side time information corresponds to the time difference information indicating the time difference from the timing of one previous positive second to the output timing of the synchronization signal.

Next, the information output portion 856 determines whether or not the elapsed time period from the output of the synchronizing signal in S36 is equal to or more than the set synchronization signal output interval (S40). If the information output portion 856 makes a determination of YES in S40, the processing returns to S36.

On the other hand, if the determination is NO in S40, the information output portion 856 determines whether or not an instruction to end the receiving processing is issued from the control circuit 50 (S41). If the information output portion 856 makes a determination of NO in S41, the processing returns to S40. According to this, the information output portion 856 outputs the synchronization signal and the reception side time information repeatedly to the control circuit 50 at the synchronization signal output interval until an instruction to end the receiving processing is issued from the control circuit 50.

Here, as the synchronization signal output interval becomes longer, the average time period necessary for time correction becomes longer. Further, for example, as the success rate of acquisition of the synchronization signal performed by the information acquisition unit 55 is lower, the average time becomes longer. The average value of success rate of acquisitions of synchronization signals varies in accordance with the information processing capability of the information acquisition unit 55, that is, the information processing capability of the control circuit 50.

Therefore, the electronic timepiece 1 is configured such that the synchronization signal output interval can be changed. In the present embodiment, the synchronization signal output interval is set as a time according to the information processing ability of the control circuit 50. Thereby, it is possible to appropriately adjust the average time period necessary for time correction.

If the determination is YES in S41, the GPS receiving circuit 45 ends the receiving processing, stops the operation, and shifts to the inactive state. Here, the inactive state refers to a state in which at least the RF receiving unit 70 and the correlation calculation processing portion 84 are not in operation.

Returning to FIG. 10, in S12, after the reception control unit 51 causes the GPS receiving circuit 45 to start the receiving processing, the control circuit 50 executes the synchronization signal acquisition processing S60.

Figure 15:
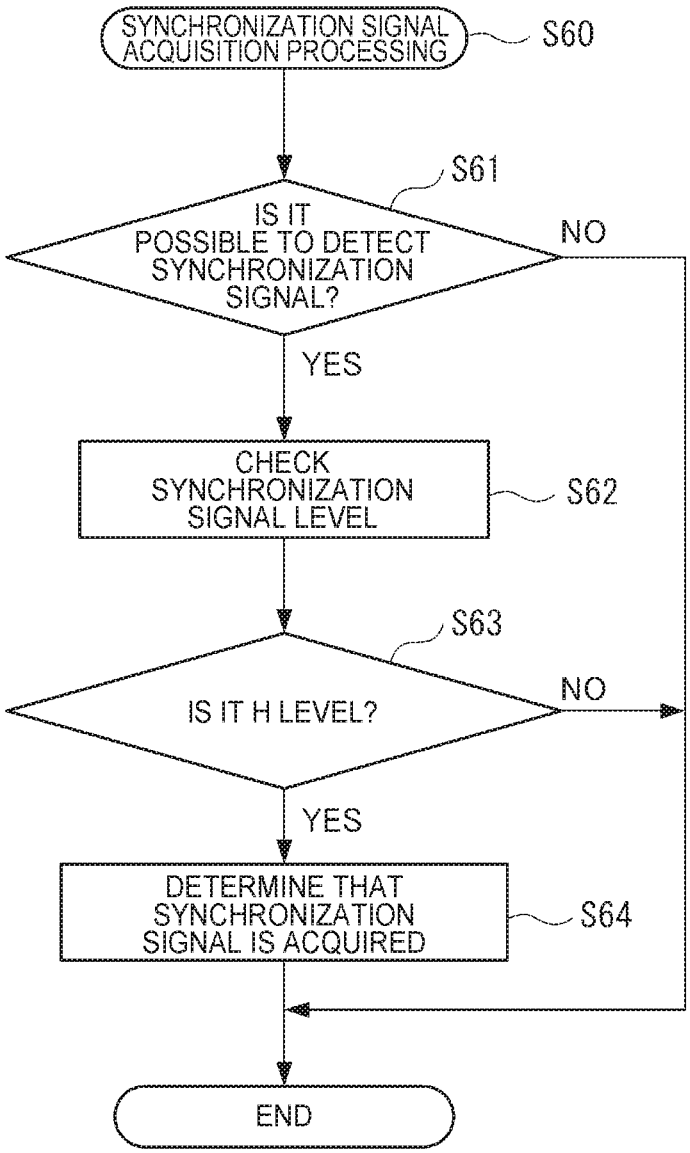
FIG. 15 is a flowchart illustrating synchronization signal acquisition processing in the first embodiment.

When the synchronization signal acquisition processing S60 is executed, as shown in FIG. 15, the information acquisition unit 55 of the control circuit 50 determines whether or not the synchronization signal which is output from the GPS receiving circuit 45 can be detected (S61). If the information acquisition unit 55 makes a determination of NO in S61, the information acquisition unit 55 ends the synchronization signal acquisition processing S60.

Here, due to the influence of the processing delay of the control circuit 50 or the like, it may take time until the synchronization signal is detected by the information acquisition unit 55 after the synchronization signal is output from the GPS receiving circuit 45. The longer the delay time period, the larger the error of the internal time after correction. Therefore, in the present embodiment, when the delay time period is equal to or less than a predetermined time, the information acquisition unit 55 determines that the synchronization signal is acquired.

Specifically, if the determination is YES in S61, the information acquisition unit 55 checks the signal level of the synchronization signal (S62) and determines whether or not the level is the H level (S63).

If the determination is YES in S63, it can be determined that the H level continues for a certain time. Therefore, it can be determined that the detected signal is not noise or the like. Further, since it can be determined that the synchronizing signal is still output, it can be determined that the delay time period does not exceed the synchronizing signal output time period. Therefore, it can be determined that the delay time period is equal to or less than the certain time. Therefore, the information acquisition unit 55 determines that the synchronization signal is acquired (S64).

After the processing in S64 or if the determination is NO in S63, the information acquisition unit 55 ends the synchronization signal acquisition processing S60.

Here, an example of the synchronization signal acquisition processing S60 will be described.

First, an example in the case where there is no delay time period will be described with reference to FIG. 16.

Figure 16:
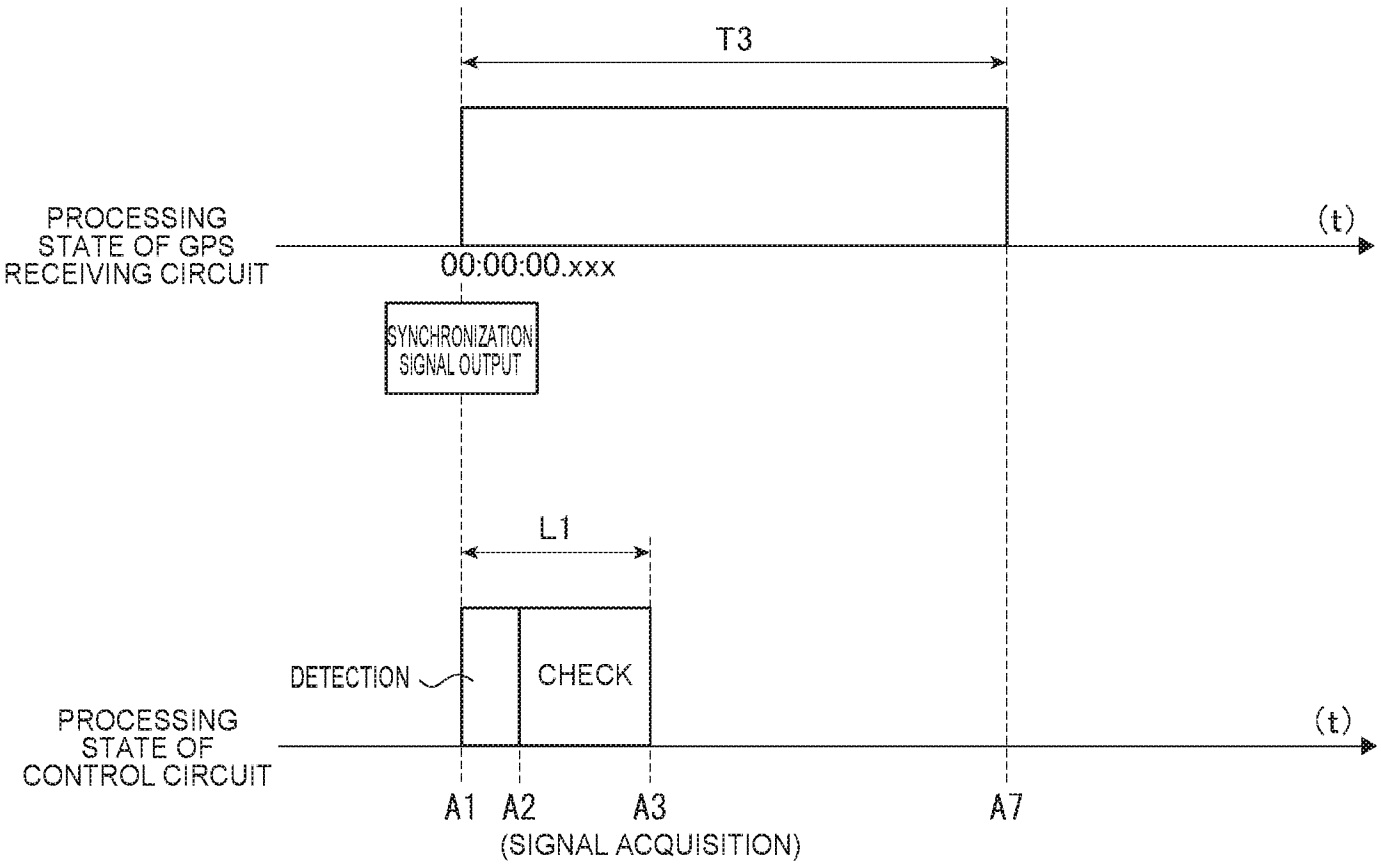
FIG. 16 is a diagram for explaining an example of synchronization signal acquisition processing in the first embodiment.

In this example, as shown in FIG. 16, the synchronization signal is output from the GPS receiving circuit 45 at timing A1. The synchronization signal is output until timing A7. That is, the time period from the timing A1 to the timing A7 is a synchronization signal output time period T3.

In this example, since there is no delay time period, the control circuit 50 executes the detection processing of the synchronization signal from the timing A1 to the timing A2.

Then, from the timing A2 to the timing A3, checking processing of checking the signal level of the synchronization signal is executed.

In this example, since the timing A3 is earlier than the timing A7, a synchronization signal of H level is output at the timing A3. Therefore, at timing A3, the control circuit 50 determines that the synchronization signal is acquired. That is, the time period from the timing A1 to the timing A3 is a synchronization signal acquisition time period L1 from when the synchronization signal is output from the GPS receiving circuit 45 to when the synchronization signal is acquired by the control circuit 50. The synchronization signal acquisition time L1 is a shift of the synchronization timing between the GPS receiving circuit 45 and the control circuit 50.

Next, an example in a case where a delay time period shorter than the synchronizing signal output time period T3 is generated due to the processing delay of the control circuit 50 will be described with reference to FIG. 17.

Figure 17:
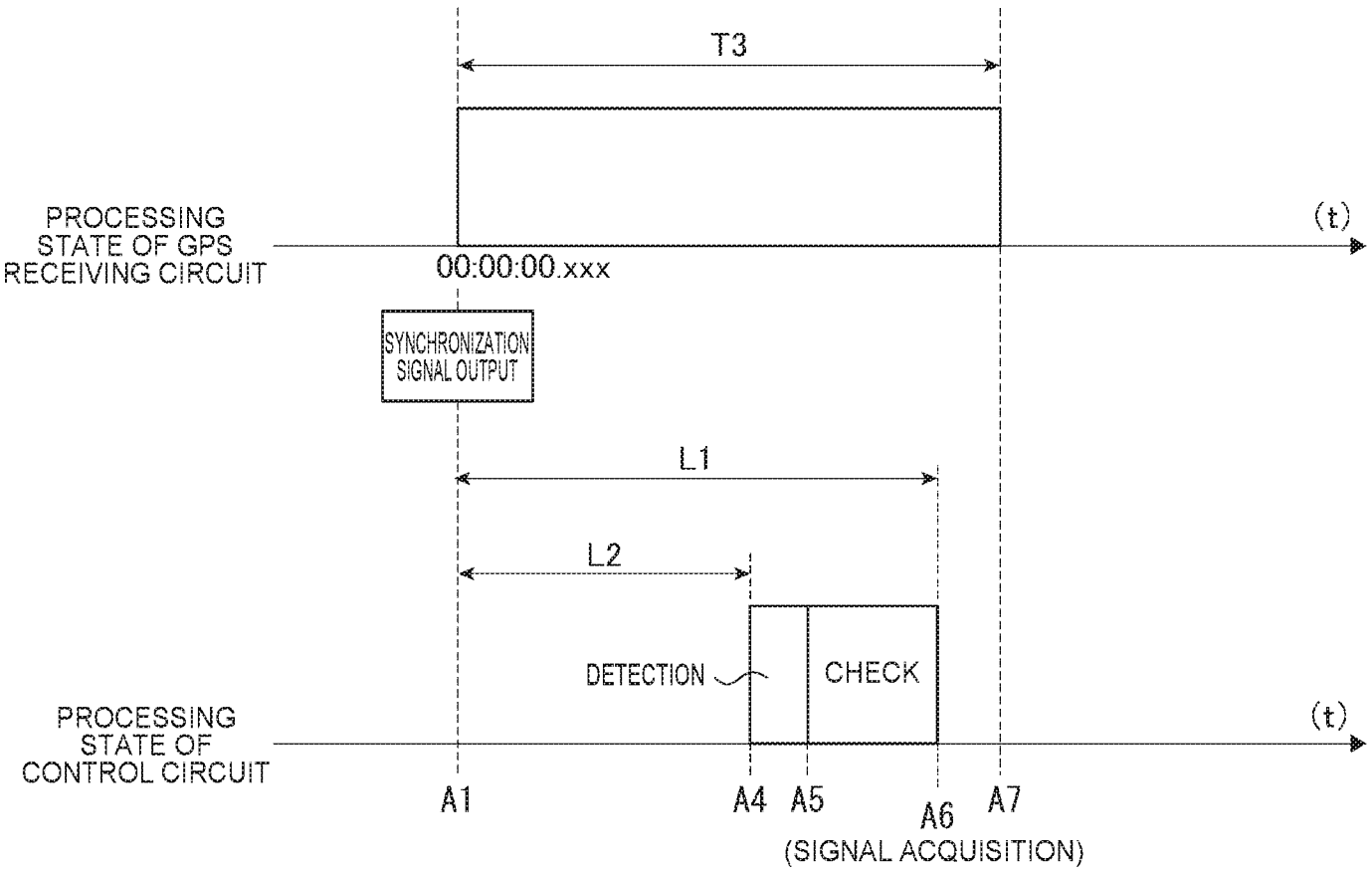
FIG. 17 is a diagram for explaining another example of the synchronization signal acquisition processing in the first embodiment.

In this example, as shown in FIG. 17, the synchronization signal is output from the GPS receiving circuit 45 at the timing A1. The synchronization signal is output until the timing A7.

In this example, since there is a delay time period, the control circuit 50 executes the detection processing of the synchronization signal, from the timing A4, which is delayed from the timing A1 by the delay time period L2, to the timing A5. Then, from the timing A5 to the timing A6, checking processing of checking the signal level of the synchronization signal is executed.

In this example, since the timing A6 is earlier than the timing A7, a synchronization signal of H level is output at the timing A6. Therefore, at the timing A6, the control circuit 50 determines that the synchronization signal is acquired. That is, the time period from the timing A1 to the timing A6 is the synchronization signal acquisition time period L1.

Next, an example in a case where a delay time period longer than the synchronizing signal output time period T3 is generated due to the processing delay of the control circuit 50 will be described with reference to FIG. 18.

Figure 18:
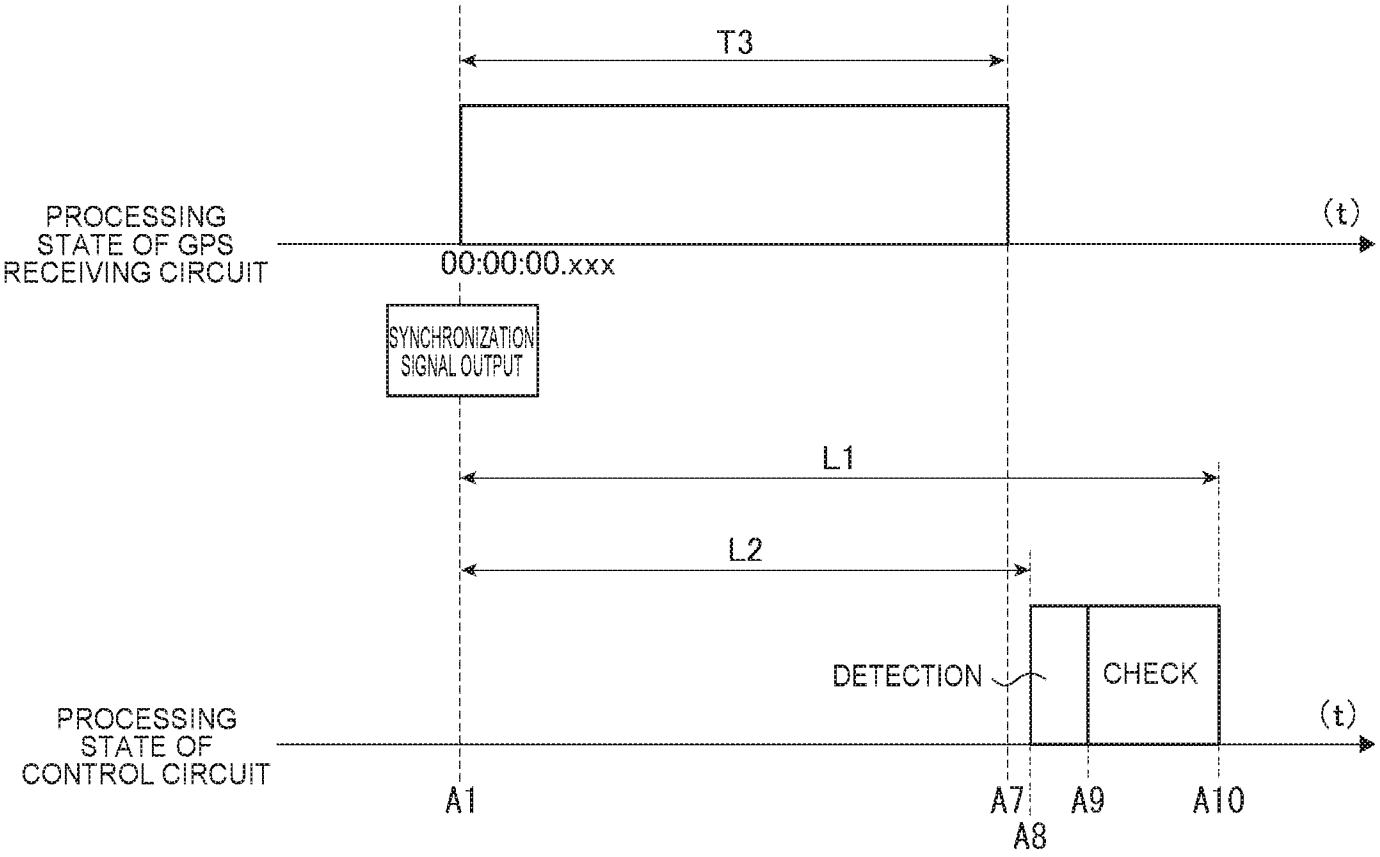
FIG. 18 is a diagram for explaining still another example of the synchronization signal acquisition processing in the first embodiment.

In this example, as shown in FIG. 18, the synchronization signal is output from the GPS receiving circuit 45 at the timing A1. The synchronization signal is output until the timing A7.

In this example, since there is a delay time period, the control circuit 50 executes the detection processing of the synchronization signal, from the timing A8, which is delayed from the timing A1 by the delay time period L2, to the timing A9. Then, from timing A9 to timing A10, checking processing of checking the signal level of the synchronization signal is executed.

In this example, since the timing A10 is after the timing A7, the synchronization signal at the H level is not output at the timing A10. Therefore, at the timing A10, the control circuit 50 determines that the synchronization signal is not acquired.

In such a manner, when the delay time period L2 is long and the synchronization signal cannot be acquired within the synchronization signal output time period T3, the control circuit 50 determines that the synchronization signal is not acquired. Thereby, the maximum value of the delay time period L2 for which the time correction is performed, that is, the maximum value of the error of the internal time after the correction can be determined on the basis of the length of the synchronization signal output time period T3.

Further, the average value of the delay time period varies in accordance with the information processing capability of the information acquisition unit 55, that is, the information processing capability of the control circuit 50.

Therefore, in the electronic timepiece 1, the synchronizing signal output time period T3 can be changed. In the present embodiment, the synchronization signal output time period T3 is set in accordance with the time accuracy of the electronic timepiece 1 and the information processing capability of the control circuit 50. Thereby, it is possible to appropriately adjust the maximum value of the error of the internal time after correction.

Returning to FIG. 10, after the synchronization signal acquisition processing S60 is completed, the information acquisition unit 55 determines whether or not the synchronization signal is acquired (S13). If the information acquisition unit 55 makes a determination of NO in S13, the information acquisition unit 55 again executes the synchronization signal acquisition processing S60.

If the determination is YES in S13, the time correction unit 53 starts measurement of the elapsed time from acquisition of the synchronization signal (S14).

Next, the information acquisition unit 55 determines whether or not the reception side time information which is output from the GPS receiving circuit 45 is acquired (S15). If the determination is NO in S15, the control circuit 50 returns the processing to S60.

As a result, each processing of S60, S13, S14, and S15 is repeatedly executed until the synchronization signal and the reception side time information are acquired or the timeout occurs.

If the determination is YES in S15, the time correction unit 53 corrects the hours, minutes, and seconds in the internal time data 613 on the basis of the hours, minutes, and seconds in the reception side time information (S16).

Next, the reception control unit 51 instructs the GPS receiving circuit 45 to end the receiving processing. As a result, the GPS receiving circuit 45 stops its operation and shifts to the inactive state (S17).

Next, the time correction unit 53 calculates the next timing of positive seconds on the basis of the synchronization signal and the time of less than a second in the reception side time information (S18).

Specifically, the time correction unit 53 calculates the difference time obtained by subtracting the time of less than a second from 1 second. Then, from the timing at which the synchronization signal is acquired, the timing, at which the calculated difference time has elapsed, can be obtained as the next timing of positive seconds.

For example, when the time of less than a second is 0.432 seconds, the timing at which 0.568 seconds (=1 second−0.432 seconds) elapse from the acquisition timing of the synchronization signal is the next timing of positive seconds.

Next, the time correction unit 53 determines whether or not the calculated next timing of positive seconds is reached (S19).

The time correction unit 53 repeatedly executes the processing of S19 until the next timing of positive seconds is reached.

If the next timing of positive seconds is reached (the determination is YES in S19), the time correction unit 53 corrects the internal time in seconds by advancing the seconds in the internal time information by 1 second, and resets the second measurement timer, thereby correcting the time of less than a second in the internal time (S20).

Then, the control circuit 50 ends the time correction processing.

Example of Time Correction Processing

Next, the time correction processing will be described with respect to examples.

Figure 19:
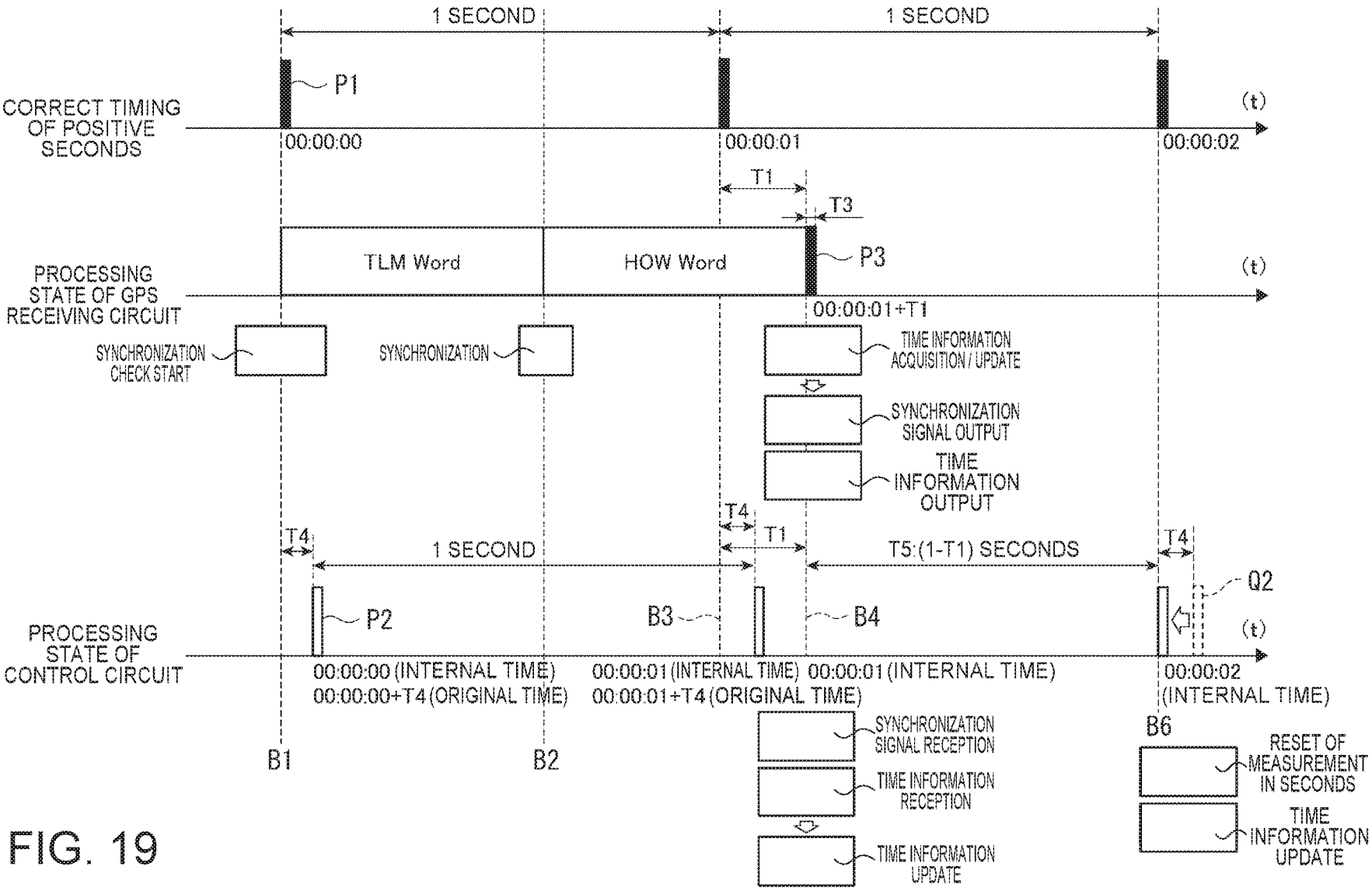
FIG. 19 is a diagram for explaining an example of time correction processing in the first embodiment.

First, an example in a case where the control circuit 50 is able to acquire the synchronization signal and the reception side time information, which is output first by the GPS receiving circuit 45, will be described with reference to FIG. 19. The horizontal axis of FIG. 19 represents the time axis, a bar line P1 represents the timing of positive seconds in the correct time (satellite transmission time), a bar line P2 represents the timing of positive seconds in the internal time, and a bar line P3 represents the output timing of the synchronization signal. A bar line Q2 indicated by a dotted line represents the timing of positive seconds in the internal time when the time correction is not performed.

In this example, the internal time is delayed by a time period T4 with respect to the timing of positive seconds in the correct time, before the time correction.

The GPS receiving circuit 45 decodes the TLM word from correct timing of positive seconds B1 (00: 00: 00 in the correct time) to timing B2 after 0.6 seconds from the timing B1, thereby acquiring the time synchronization information. Then, the time of less than a second in the reception side time information is corrected (synchronized).

Then, the GPS receiving circuit 45 decodes the HOW word from the timing B2 to timing B4 after 0.6 seconds therefrom, thereby acquiring the GPS time information. Then, the hours, minutes, and seconds in the reception side time information is corrected (updated).

Then, at the timing B4, the GPS receiving circuit 45 outputs the synchronization signal and the reception side time information to the control circuit 50. The synchronization signal is output during the synchronization signal output time period T3. The time of less than a second in the reception side time information corresponds to a time difference T1 between timing B3 (00: 00: 01 at a correct time), which is a timing of positive seconds previous to the timing B4, and the timing B4.

At the timing B4, the control circuit 50 acquires (receives) the synchronization signal and the reception side time information. Then, the hours, minutes, and seconds in the internal time are corrected on the basis of the hours, minutes, and seconds in the reception side time information. In this example, the hours, minutes, and seconds in the internal time before the correction at the timing B4 is 00: 00: 01, and coincides with the hours, minutes, and seconds in the reception side time information, and therefore the hours, minutes, and seconds after the correction are similarly 00: 00: 01.

Since the control circuit 50 is able to acquire the synchronization signal and the reception side time information, the control circuit 50 stops the GPS receiving circuit 45, and makes the GPS receiving circuit 45 in an inactive state.

The control circuit 50 calculates a time period T5 (=1−T1) from the timing B4 to timing B6 (00: 00: 02 in the correct time), which is the next timing of positive seconds, on the basis of the time of less than a second in the reception side time information, that is, the time difference T1. When the time period T5 has elapsed from the timing B4, the control circuit 50 determines that the timing B6 is reached, advances the internal time in seconds by 1 second, and resets the second measurement timer. Thereby, the internal time is advanced by the time period T4 and corrected to 00: 00: 02 (positive seconds) which is the correct time.

Figure 20:
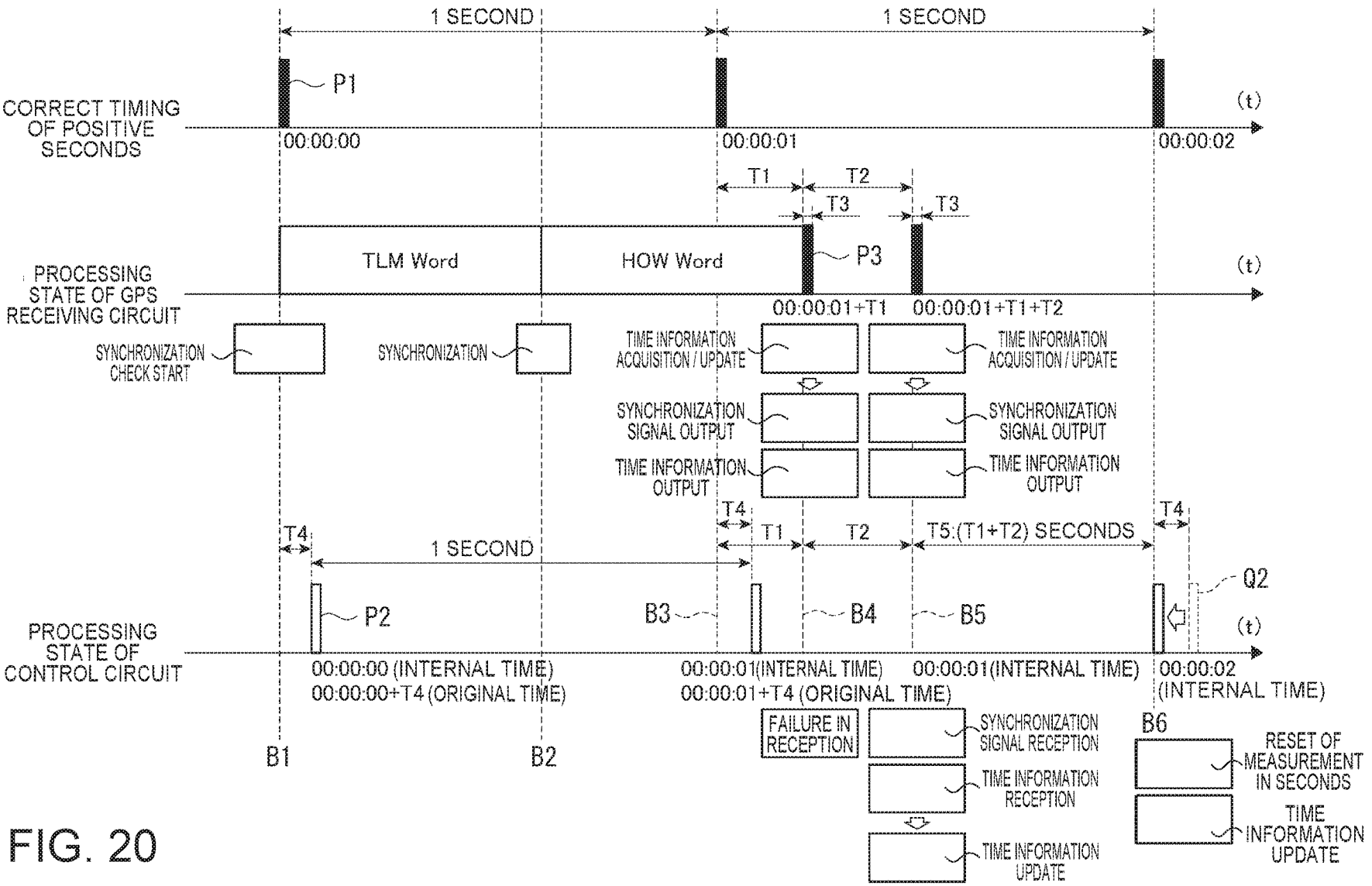
FIG. 20 is a view for explaining another example of the time correction processing in the first embodiment.

Next, referring to FIG. 20, a description will be given of the following case: the control circuit 50 cannot acquire the synchronization signal and the reception side time information which are first output by the GPS receiving circuit 45, and the control circuit 50 acquires the synchronization signal and the reception side time information which are output by the GPS receiving circuit 45 for the second time.

In this example, the control circuit 50 cannot acquire the synchronization signal and the reception side time information at the timing B4 when the synchronization signal and the reception side time information are first output from the GPS receiving circuit 45. Therefore, the GPS receiving circuit 45 continues to operate even after the timing B4. Then, the GPS receiving circuit 45 outputs again the synchronization signal and the reception side time information to the control circuit 50 at the timing B5 after the synchronization signal output interval T2 from the timing B4.

At the timing B5, the control circuit 50 acquires the synchronization signal and the reception side time information. Then, the hours, minutes, and seconds in the internal time are corrected on the basis of the hours, minutes, and seconds in the reception side time information. In this example, the hours, minutes, and seconds in the internal time before the correction at the timing B5 is 00: 00: 01, and coincides with the hours, minutes, and seconds in the reception side time information, and therefore the hours, minutes, and seconds after the correction are similarly 00: 00: 01.

Since the control circuit 50 is able to acquire the synchronization signal and the reception side time information, the control circuit 50 stops the GPS receiving circuit 45, and makes the GPS receiving circuit 45 in an inactive state.

The control circuit 50 calculates the time period T5 (=1−(T1+T2)) from the timing B5, on the basis of the time of less than a second in the reception side time information, that is, the time obtained by adding the synchronization signal output interval T2 to the time difference T1. When the time period T5 has elapsed from the timing B5, the control circuit 50 determines that the timing B6 is reached, advances the internal time in seconds by 1 second, and resets the second measurement timer. Thereby, the internal time is advanced by the time period T4 and corrected to 00: 00: 02 (positive seconds) which is the correct time.

Operational Effect of First Embodiment

After the GPS receiving circuit 45 acquires the time synchronization information and the GPS time information, the time correction unit 53 of the control circuit 50 is able to correct the hours, minutes, and seconds in the internal time on the basis of the GPS time information, before the next timing of positive seconds. Therefore, the time period necessary for time correction can be shortened as compared with a case where the GPS receiving circuit 45 waits for the next timing of positive seconds and transmits data.

At the timing at which the GPS receiving circuit 45 acquires the time synchronization information and the GPS time information, the time correction unit 53 calculates the next timing of positive seconds on the basis of the synchronization signal and the reception side time information (the time of less than a second) which are output from the GPS receiving circuit 45, resets the second measurement timer when the next timing of positive seconds is reached, and corrects the time of less than a second in the internal time. According to this, since the time of less than a second in the internal time is corrected, it is unnecessary to output the synchronization signal from the GPS receiving circuit 45 at the next timing of positive seconds, for example. For this reason, in the present embodiment, when the information acquisition unit 55 acquires the synchronization signal and the reception side time information, the GPS receiving circuit 45 is set in an inactive state. According to this, the power consumption can be reduced as compared with a case where the GPS receiving circuit 45 is continuously operated even after the information acquisition unit 55 acquires the synchronization signal and the reception side time information.

When the information acquisition unit 55 fails to acquire the synchronization signal and the reception side time information which are output from the GPS receiving circuit 45, the GPS receiving circuit 45 repeatedly outputs the synchronization signal and the reception side time information at the synchronization signal output interval T2. According to this, even when the information acquisition unit 55 fails to acquire the synchronization signal and the reception side time information which are output from the GPS receiving circuit 45, if the acquisition of the synchronization signal and the reception side time information which are output from the GPS receiving circuit 45 from the next time can be successful, the time correction unit 53 is able to correct the internal time.

Since the synchronization signal output interval T2 is set to have a length corresponding to the information processing capability of the control circuit 50, the average time period necessary for time correction can be appropriately adjusted.

The synchronizing signal output time period T3 is set as a time period corresponding to the information processing capability of the control circuit 50. Therefore, it is possible to appropriately adjust the maximum value of the error of the internal time after correction.

Second Embodiment

For example, when a user periodically checks the displayed time of the electronic timepiece and there is a shift in the displayed time, in a case where the time may be corrected manually, the error of the internal time is kept to be a small value. In such a manner, when the error of the internal time is kept to be less than ±0.5 seconds, as will be described in detail later, the internal time is corrected correctly on the basis of the synchronization signal and the time of less than a second in the reception side time information.

In the second embodiment, as described above, an electronic timepiece, which is capable of maintaining the error of the internal time at less than ±0.5 seconds and correctly correcting the internal time on the basis of the synchronization signal and the time of less than a second in the reception side time information, is assumed.

The electronic timepiece of the second embodiment includes a less-than-second measurement unit that measures a time of less than a second, for example, in units of 1 msec. The time of less than a second in the internal time of the electronic timepiece is determined by a measurement value of the less-than-second measurement unit. The other structures and circuit configurations of the electronic timepiece of the second embodiment are the same as those of the electronic timepiece 1 of the first embodiment, and therefore the description thereof will be omitted.

FIGS. 21 to 24 are flowcharts illustrating time correction processing according to the second embodiment.

Figure 22:
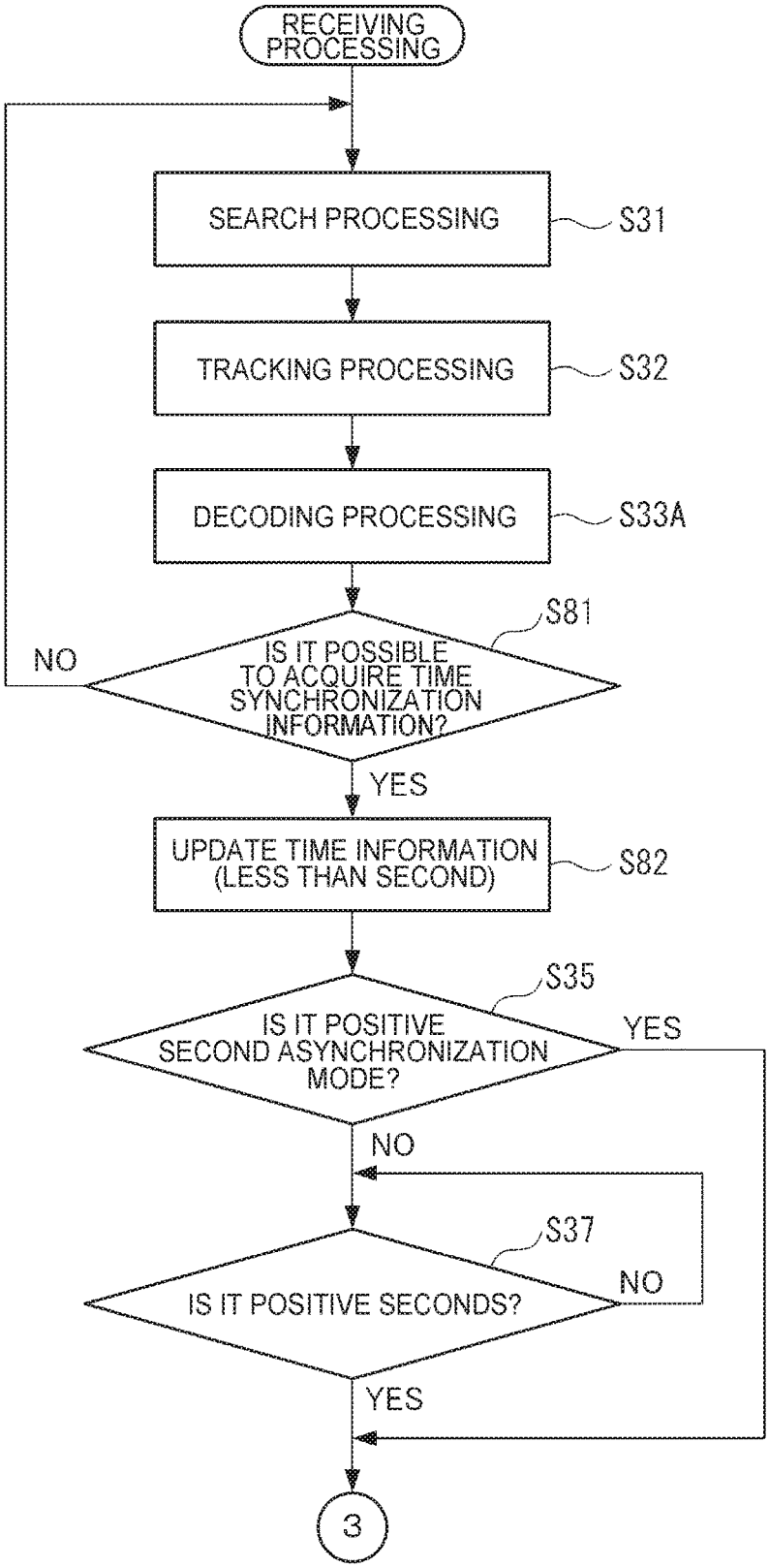
FIG. 22 is a flowchart illustrating receiving processing in the second embodiment.
Figure 23:
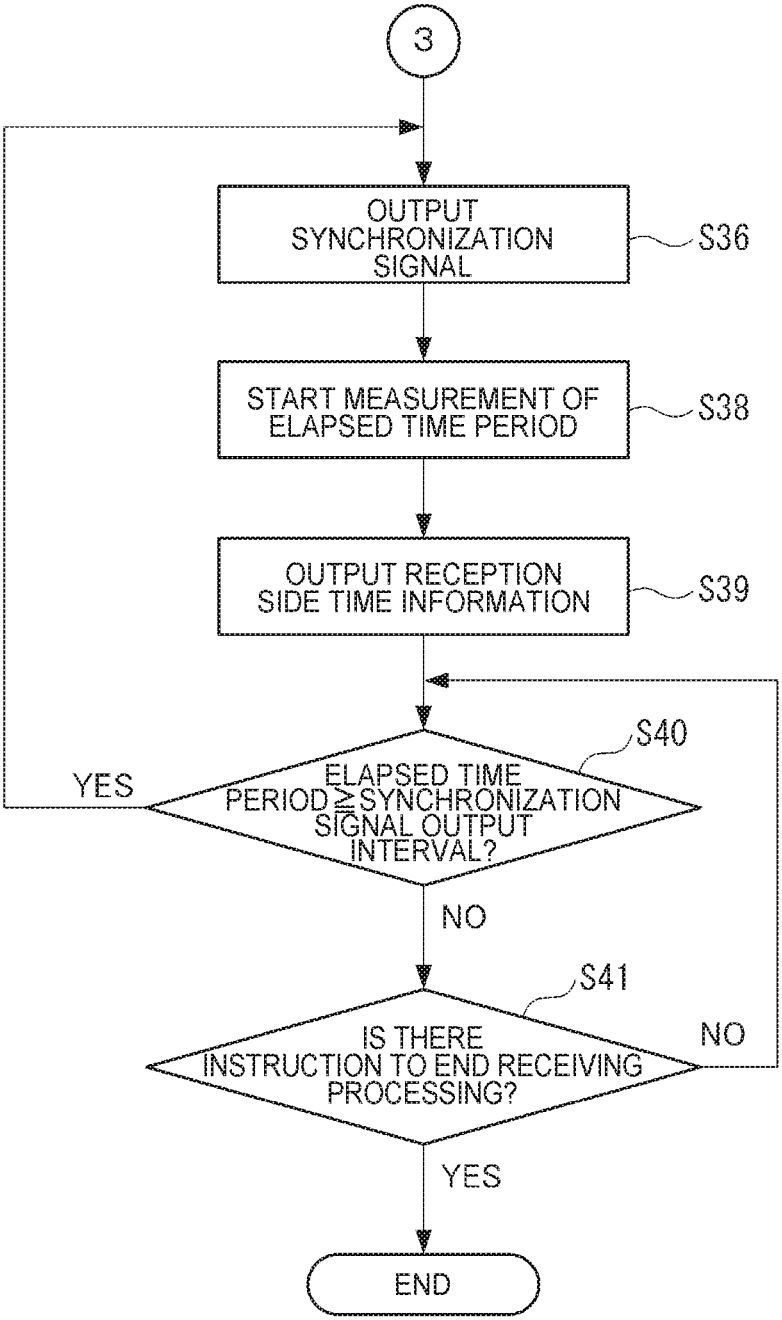
FIG. 23 is a flowchart illustrating the receiving processing in the second embodiment.

In the time correction processing of the present embodiment, when the GPS receiving circuit 45 executes the receiving processing, as shown in FIG. 22, the GPS receiving circuit 45 executes processing of S31, S32, S33A, S35 to S41, S81, and S82. Here, the processing of S31, S32, S35 to S41 is the same as the processing of S31, S32, S35 to S41 of the first embodiment, and therefore the description thereof will be omitted.

In the present embodiment, in S33A, the GPS receiving circuit 45 causes the information acquisition portion 854 to execute decoding processing of acquiring the time synchronization information included in the navigation message. That is, the GPS time information is not acquired.

After the decoding processing is executed in S33A, the time correction portion 855 of the GPS receiving circuit 45 determines whether or not time synchronization information can be acquired (S81). If the determination is NO in S81, the baseband control portion 85 returns the processing to S31.

If the determination is YES in S81, the time correction portion 855 acquires a time of less than a second on the basis of the time synchronization information, and corrects (updates) the time of less than a second in the reception side time data 91 (S82).

Then, the GPS receiving circuit 45 advances the processing to S35, determines whether or not the set correction mode is the positive second asynchronization mode, outputs the synchronization signal to the control circuit 50 in S36 if the positive second asynchronization mode is set, and outputs the reception side time information to the control circuit 50 in step S39.

That is, in the present embodiment, the GPS receiving circuit 45 outputs the synchronization signal and the reception side time information to the control circuit 50 at the timing at which the time synchronization information can be acquired. Here, the reception side time information to be output may include at least a time of less than a second, and may not have to include the time of hours, minutes, and seconds.

Figure 21:
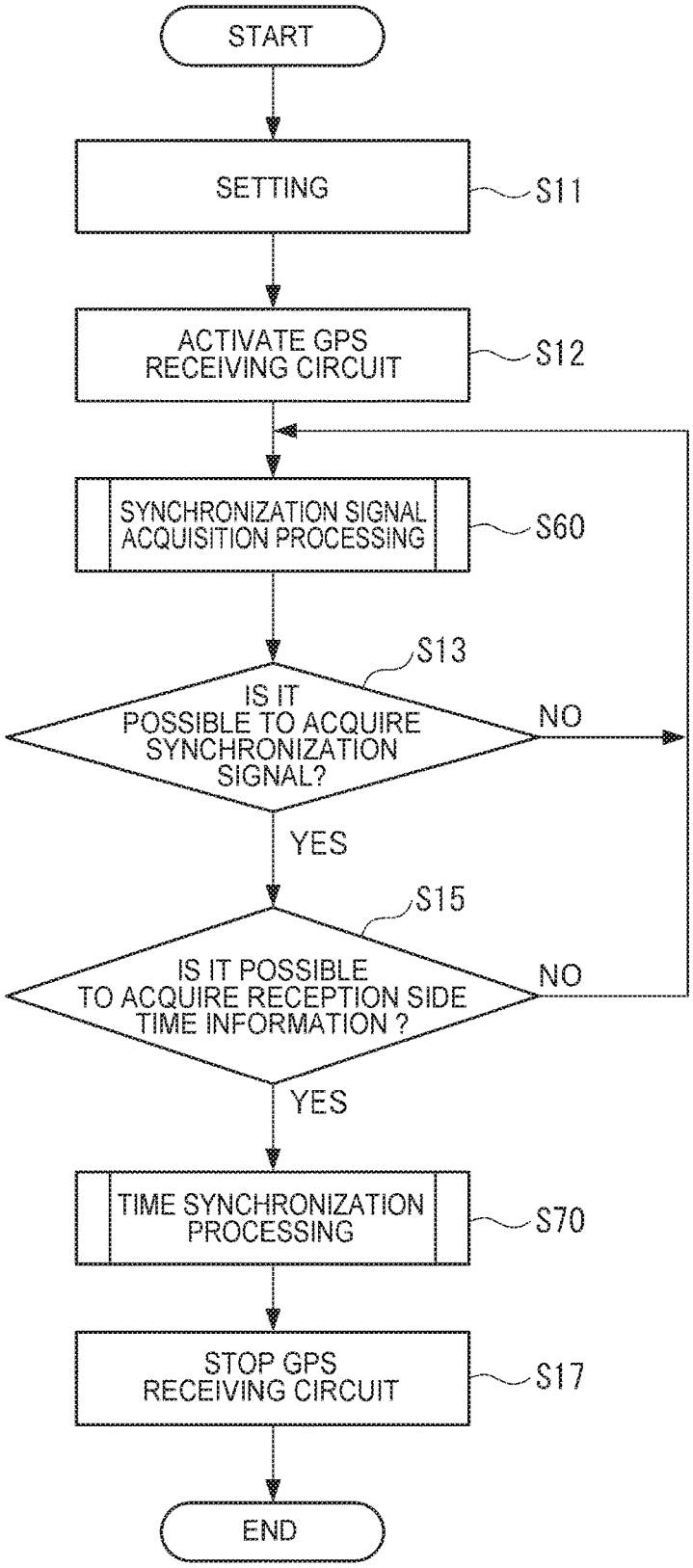
FIG. 21 is a flowchart illustrating time correction processing according to a second embodiment of the invention.

On the other hand, as shown in FIG. 21, the control circuit 50 executes processing of S11 to S13, S15, S17, S60, and S70. Here, the processing of S11 to S13, S15, S17, and S60 is the same as the processing of S11 to S13, S15, S17, and S60 of the first embodiment, and therefore the description thereof will be omitted.

In the present embodiment, after it is determined that the synchronization signal can be acquired in S13, it is determined whether or not the reception side time information can be acquired in S15. Then, when it is determined that the reception side time information can be obtained, the time correction unit 53 executes time synchronization processing S70.

Here, in the electronic timepiece of the present embodiment, the error of the internal time is kept to be less than ±0.5 seconds. Therefore, the internal time in seconds may be the same as the correct time in seconds, the internal time in seconds may be advanced by 1 second relative to the correct time in seconds, and the internal time in seconds may be delayed by 1 second relative to the correct time in seconds.

In the time synchronization processing S70, it is determined which of these states the internal time is, and the internal time in seconds and the time of less than a second are corrected in accordance with the determination result.

Figure 25:
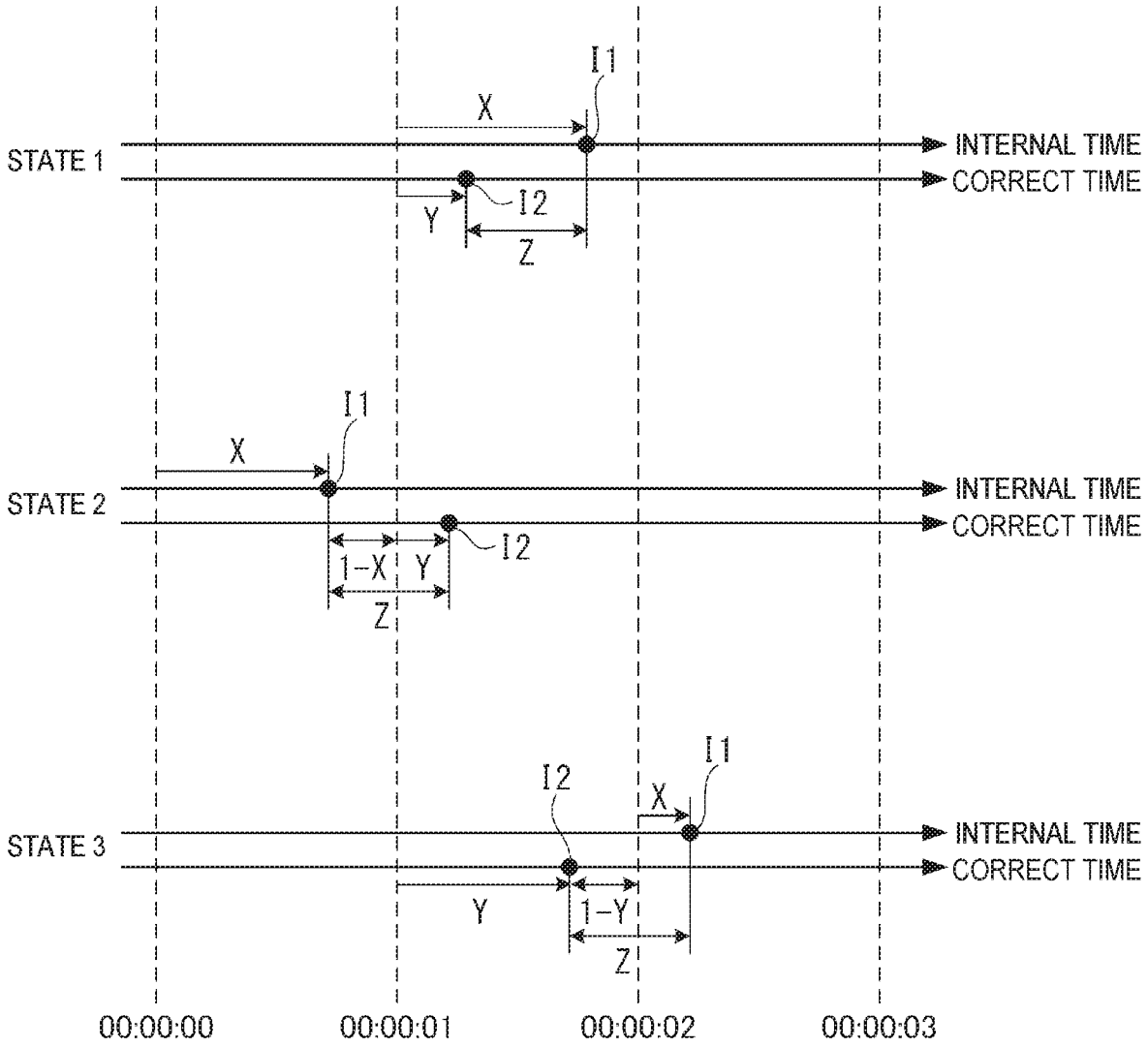
FIG. 25 is a diagram for explaining the time synchronization processing in the second embodiment.

For example, states 1 to 3 in FIG. 25 indicate internal time I1 at a certain timing and correct time (satellite transmission time) 12. In the following description, it is assumed that the time of less than a second in the internal time is X, the time of less than a second in the correct time is Y, and the absolute value of the error of the internal time with respect to the correct time is Z.

As shown in the state 1 of FIG. 25, when the internal time in seconds is the same as the correct time in seconds, the absolute value of X−Y is Z. Here, since Z is less than 500 msec, the absolute value of X−Y is less than 500 msec.

As shown in the state 2, when the internal time in seconds is delayed by 1 second from the correct time in seconds, the relation of Z=1−X+Y is established. That is, X−Y=1−Z. Since Z is less than 500 msec, X−Y>500 msec.

As shown in the state 3, when the internal time in seconds is advanced by 1 second from the correct time in seconds, the relation of Z=1−Y+X is established. That is, X−Y=Z−1. Since Z is less than 500 msec, X−Y<−500 msec.

Therefore, if the absolute value of X−Y is less than 500 msec, the time of less than a second in the internal time is corrected to the time of less than a second in the reception side time information. If X−Y>500 msec, the internal time in seconds is incremented by 1 second, and the time of less than a second is corrected to the time of less than a second in the reception side time information. If X−Y<−500 msec, the internal time in seconds is delayed by 1 second and the time of less than a second is corrected to the time of less than a second in the reception side time information. In such a manner, the internal time can be corrected correctly.

Figure 24:
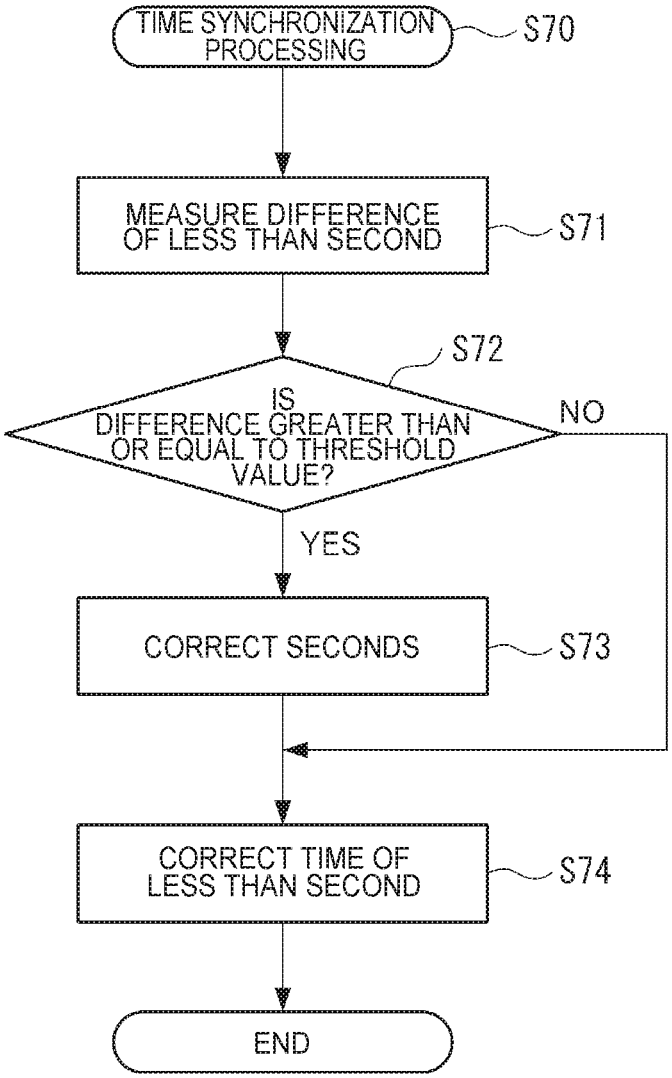
FIG. 24 is a flowchart illustrating time synchronization processing in the second embodiment.

Specifically, as shown in FIG. 24, when the time synchronizing processing S70 is executed, the time correction unit 53 calculates a difference (difference of less than a second) obtained by subtracting the time of less than a second in the acquired reception side time information from the time of less than a second in the internal time (S71).

Next, the time correction unit 53 determines whether or not the absolute value of the calculated difference of less than a second is equal to or greater than a preset threshold value (S72). In the present embodiment, the threshold value is set to 500 msec.

When the error of the internal time is kept to be a smaller value, the threshold value can be set as a value greater than 500 msec. For example, when the error of the internal time is less than 300 msec, the threshold value may be set to 700 msec.

If the determination is YES in S72, the time correction unit 53 increments the internal time in seconds by 1 second if the calculated difference of less than a second is a positive value, and decrements the internal time in seconds by 1 second if the difference of less than a second is a negative value. In addition, when it is necessary to change the internal time in minutes, for example, when the internal time is corrected from 59 seconds to 0 second, the internal time in minutes is also corrected in accordance therewith. Likewise, when it is necessary to change the internal time in hours, for example, when the internal time is corrected from 59 minutes 59 seconds to 0 minute 0 second, the internal time in hours is also corrected in accordance therewith.

After the processing in S73 or if the determination is NO in S72, the time correction unit 53 corrects the measured value of the less-than-second measurement unit on the basis of the time of less than a second in the reception side time information, thereby correcting the time of less than a second in the internal time.

Returning to FIG. 21, after the time synchronizing processing S70 ends, in S17, the control circuit 50 stops the GPS receiving circuit 45, and ends the processing.

Example of Time Correction Processing

Next, the time correction processing will be described using an example.

Figure 26:
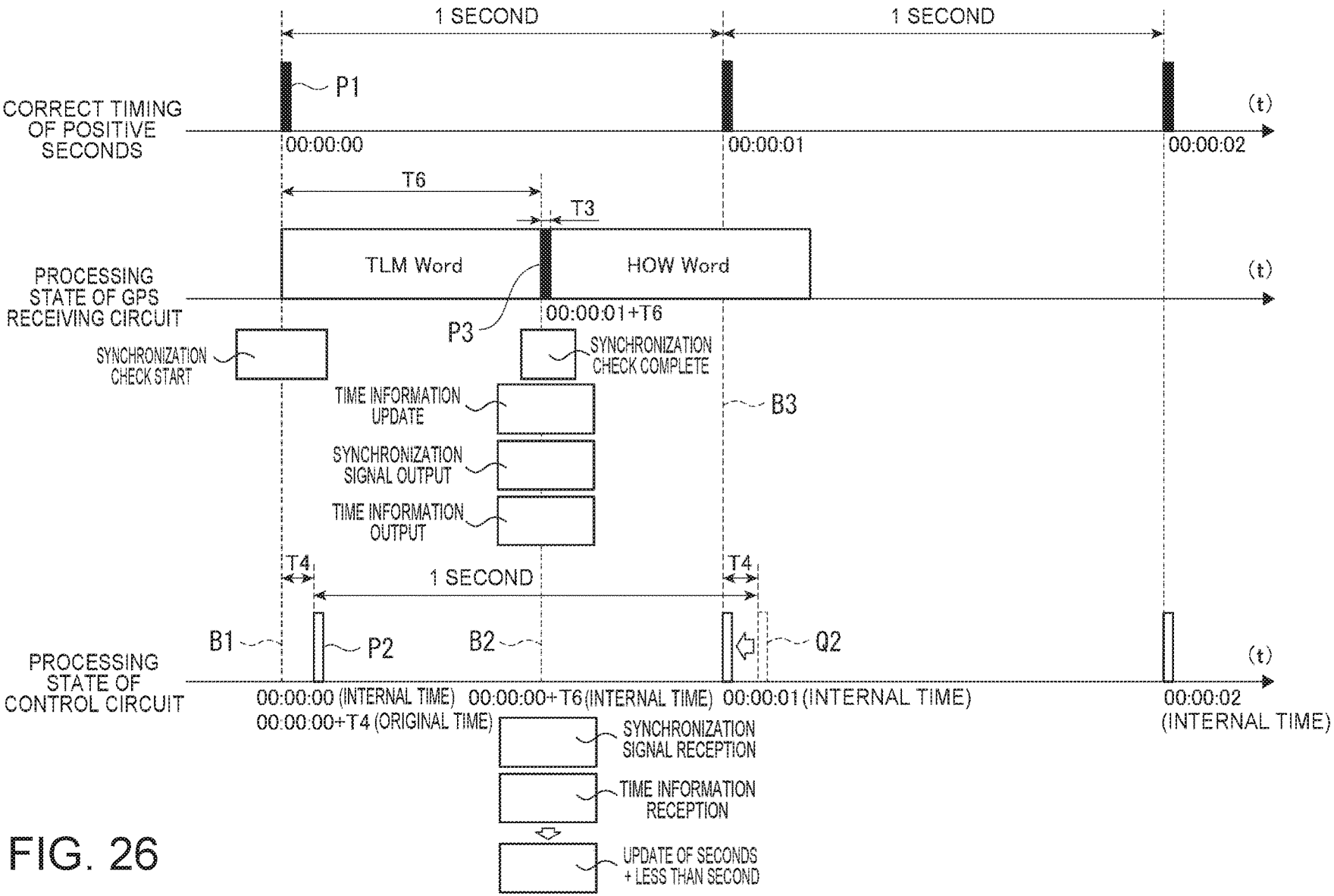
FIG. 26 is a diagram for explaining an example of the time correction processing in the second embodiment.

Here, an example in a case where the control circuit 50 is able to acquire the synchronization signal and the reception side time information, which is output first by the GPS receiving circuit 45, will be described with reference to FIG. 26.

In this example, the internal time is delayed by the time period T4 with respect to the correct time, before the time correction. The time period T4 is less than 500 msec.

In this example, the GPS receiving circuit 45 decodes the TLM word, and corrects the time of less than a second in the reception side time information at the timing B2 (00: 00: 00+T6) at which the time synchronization information is acquired.

Then, at the timing B2, the GPS receiving circuit 45 outputs the synchronization signal and the reception side time information (time of less than a second) to the control circuit 50.

At the timing B2, the control circuit 50 acquires the synchronization signal and the reception side time information. Then, the internal time is corrected on the basis of the time of less than a second in the reception side time information. In this example, the absolute value of the difference of less than a second, which is obtained by subtracting the time of less than a second in the reception side time information from the time of less than a second in the internal time, is the time period T4, and is less than 500 msec as a threshold value. Therefore, the internal time in seconds is not corrected, and the time of less than a second in the internal time is corrected. Thereby, the internal time is advanced by time period T4, and corrected to 00: 00: 00+T6 which is the correct time.

Regarding the time correction processing, a plurality of examples, in which the shift of the internal time before correction relative to the correct time is different, will be described.

Figure 27:
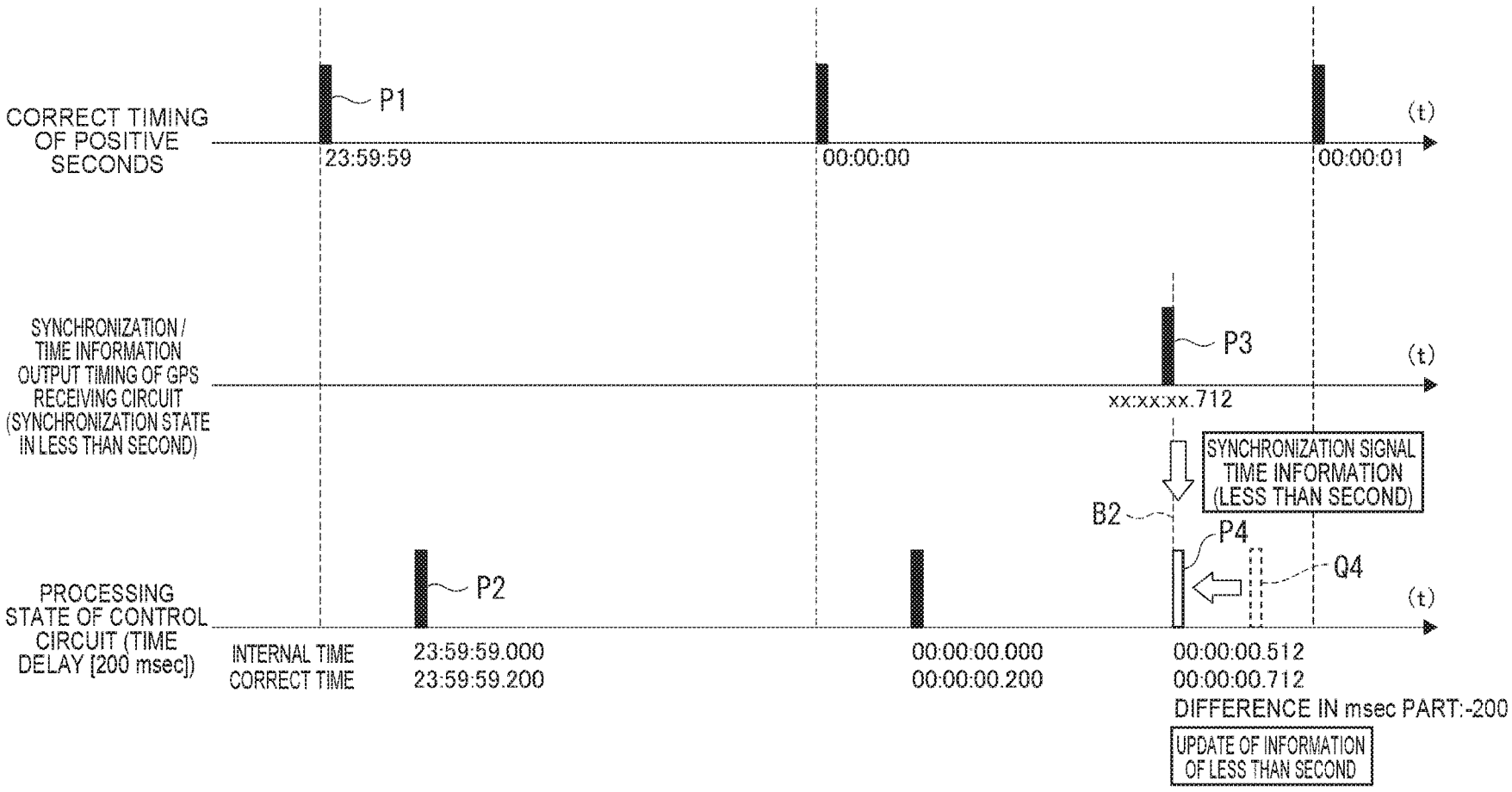
FIG. 27 is a diagram for explaining an example of the time correction processing in a case where the internal time in the second embodiment is delayed by 200 msec.

In the example shown in FIG. 27, the internal time is delayed by 200 msec from the correct time, the internal time is 00: 00: 00.512 at the timing B2 at which the synchronization signal and the reception side time information are output, and the correct time is 00: 00: 00.712. A bar line Q4 indicated by a dotted line represents the timing at which the internal time before the time correction is 00: 00: 00.712. A bar line P4 indicated by a solid line represents the timing at which the internal time after time correction is 00: 00: 00.712.

In this case, the absolute value of the difference of less than a second (−200 msec), which is obtained by subtracting the time of less than a second (0.712 seconds) in the reception side time information from the time of less than a second (0.512 seconds) in the internal time, is less than 500 msec as the threshold value. Therefore, the internal time in seconds is not corrected, and the time of less than a second in the internal time is corrected. Thereby, the internal time is advanced by 200 msec, and corrected to 00: 00: 00.712 which is the correct time.

Figure 28:
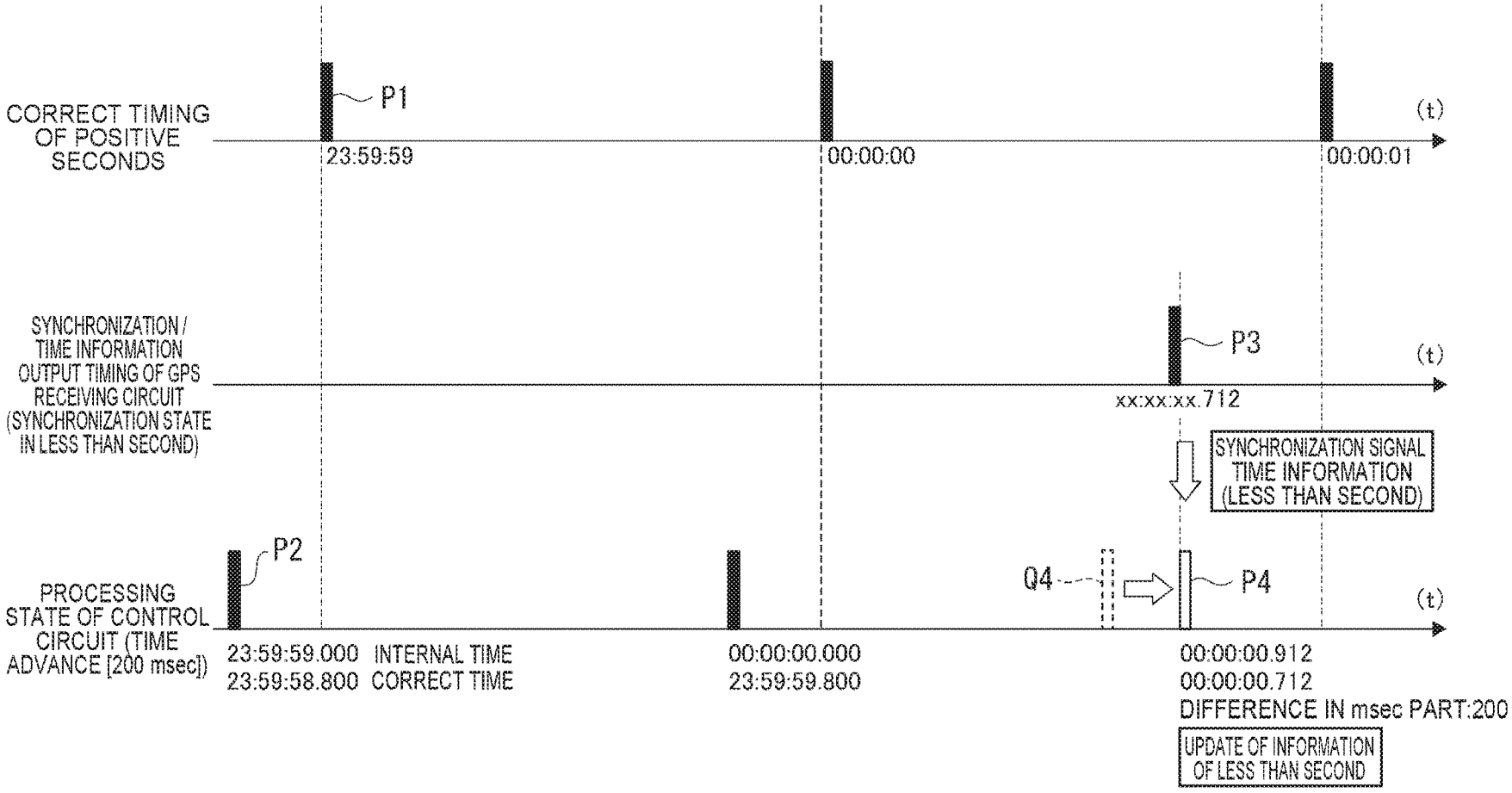
FIG. 28 is a diagram for explaining an example of the time correction processing in a case where the internal time in the second embodiment is advanced by 200 msec.

In the example shown in FIG. 28, the internal time is advanced by 200 msec from the correct time, the internal time is 00: 00: 00.912 at the timing B2 at which the synchronization signal and the reception side time information are output, and the correct time is 00: 00: 00.712.

In this case, the absolute value of the difference of less than a second (200 msec), which is obtained by subtracting the time of less than a second (0.712 seconds) in the reception side time information from the time of less than a second (0.912 seconds) in the internal time, is less than 500 msec as the threshold value. Therefore, the internal time in seconds is not corrected, and the time of less than a second in the internal time is corrected. Thereby, the internal time is decremented by 200 msec, and corrected to 00: 00: 00.712 which is the correct time.

Figure 29:
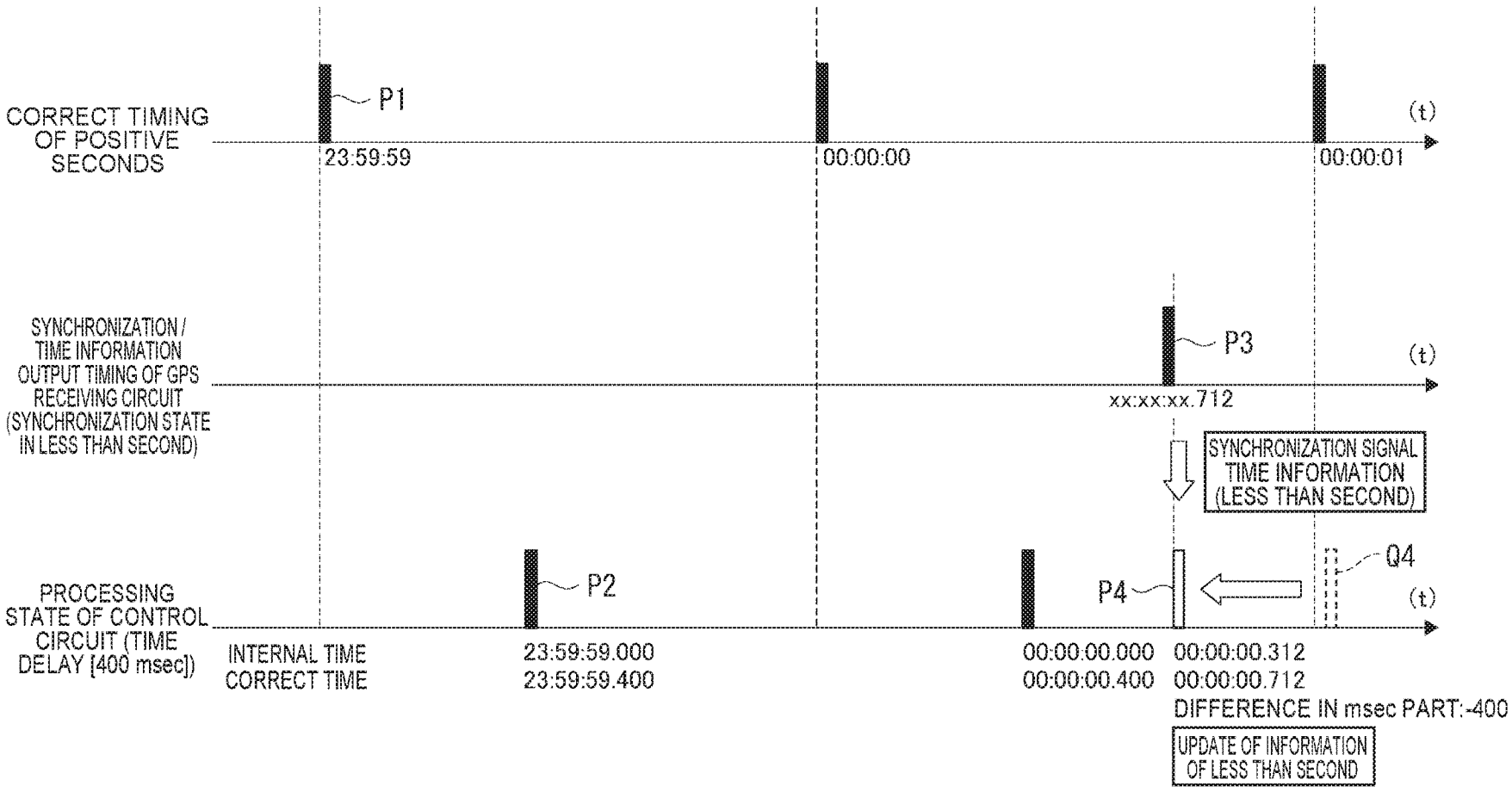
FIG. 29 is a diagram for explaining an example of the time correction processing in a case where the internal time in the second embodiment is delayed by 400 msec.

In the example shown in FIG. 29, the internal time is delayed by 400 msec from the correct time, the internal time is 00: 00: 00.312 at the timing B2 at which the synchronization signal and the reception side time information are output, and the correct time is 00: 00: 00.712.

In this case, the absolute value of the difference of less than a second (−400 msec), which is obtained by subtracting the time of less than a second (0.712 seconds) in the reception side time information from the time of less than a second (0.312 seconds) in the internal time, is less than 500 msec as the threshold value. Therefore, the internal time in seconds is not corrected, and the time of less than a second in the internal time is corrected. Thereby, the internal time is advanced by 400 msec, and corrected to 00: 00: 00.712 which is the correct time.

Figure 30:
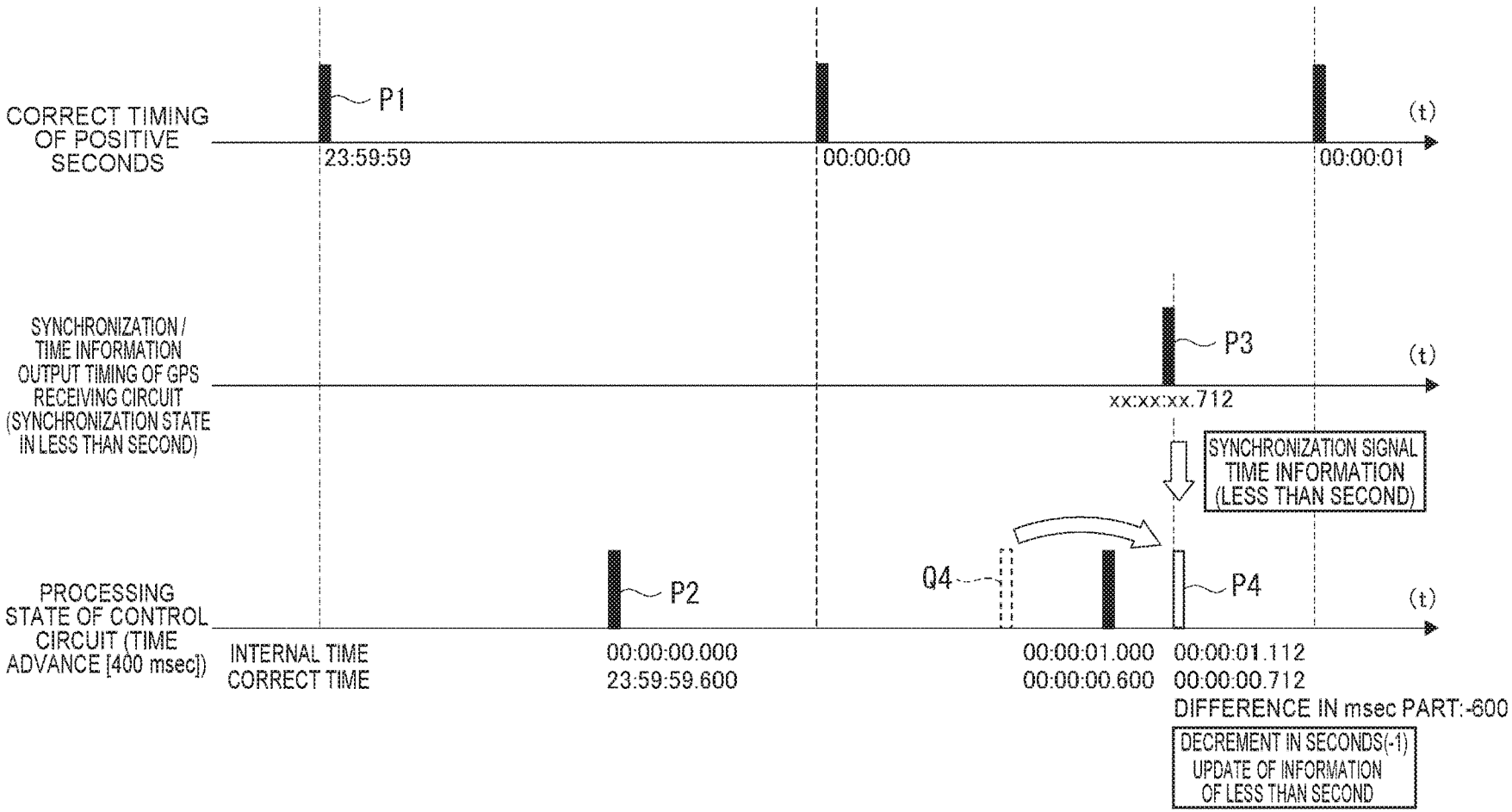
FIG. 30 is a diagram for explaining an example of the time correction processing in a case where the internal time in the second embodiment is advanced by 400 msec.

In the example shown in FIG. 30, the internal time is advanced by 400 msec from the correct time, the internal time is 00: 00: 01.112 at the timing B2 at which the synchronization signal and the reception side time information are output, and the correct time is 00: 00: 00.712.

In this case, the absolute value of the difference of less than a second (−600 msec), which is obtained by subtracting the time of less than a second (0.712 seconds) in the reception side time information from the time of less than a second (0.112 seconds) in the internal time, is equal to or greater than 500 msec as the threshold value. Therefore, the internal time in seconds is corrected. Since the difference of less than a second is a negative value, it can be determined that the internal time is advanced with respect to the correct time, and the internal time in seconds is decremented by 1 second (shifted back by 1 second). Further, the time of less than a second in the internal time is corrected. Thereby, the internal time is decremented by 400 msec, and corrected to 00: 00: 00.712 which is the correct time.

Figure 31:
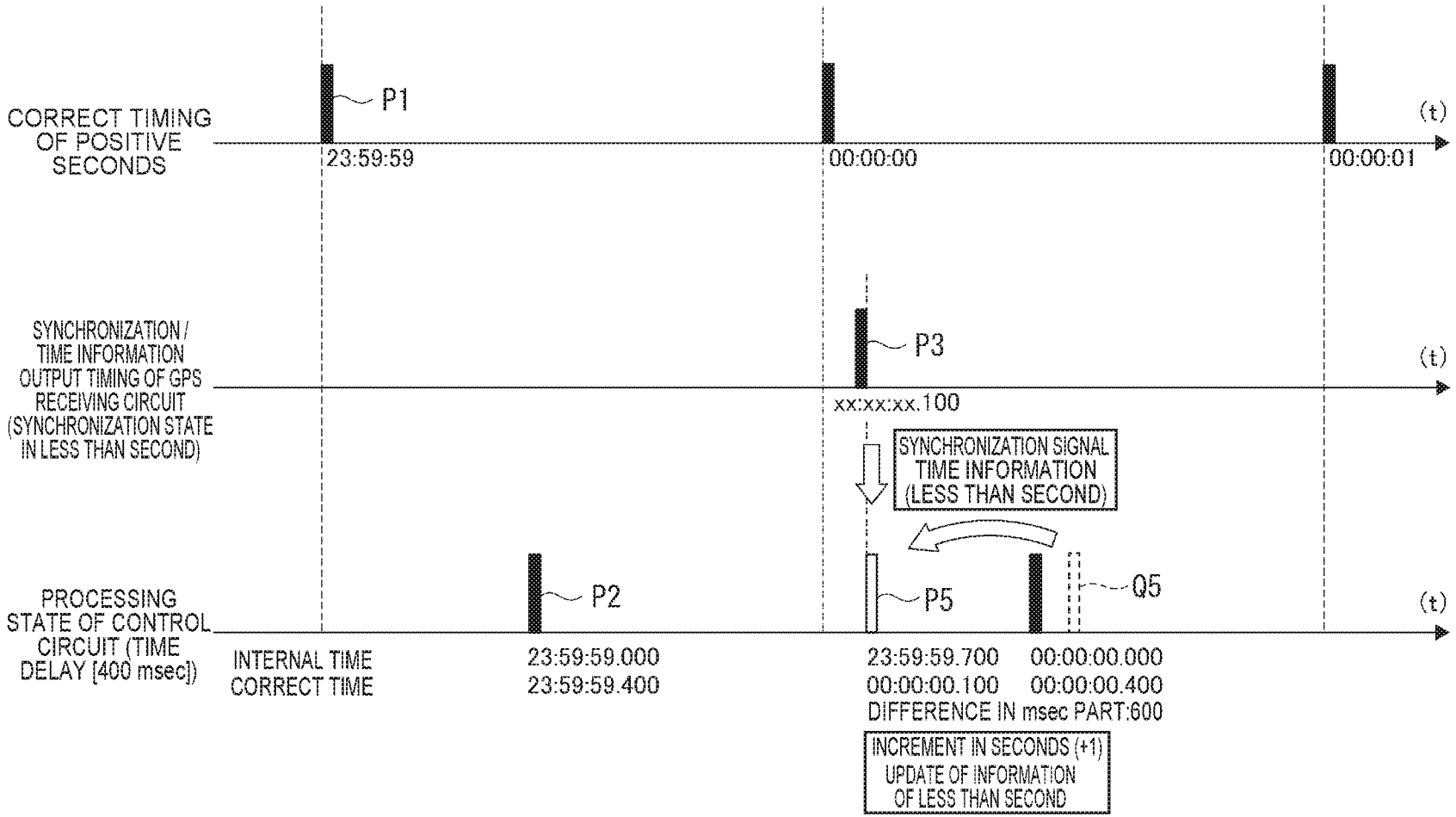
FIG. 31 is a diagram for explaining another example of the time correction processing in the case where the internal time in the second embodiment is delayed by 400 msec.

In the example shown in FIG. 31, the internal time is delayed by 400 msec from the correct time, the internal time is 23: 59: 59.700 at the timing B2 at which the synchronization signal and the reception side time information are output, and the correct time is 00: 00: 00.100. A bar line Q5 indicated by a dotted line represents the timing at which the internal time before the time correction is 00: 00: 00.100. A bar line P5 indicated by a solid line represents the timing at which the internal time after time correction is 00: 00: 00.100.

In this case, the absolute value of the difference of less than a second (600 msec), which is obtained by subtracting the time of less than a second (0.100 seconds) in the reception side time information from the time of less than a second (0.700 seconds) in the internal time, is equal to or greater than 500 msec as the threshold value. Therefore, the internal time in seconds is corrected. Since the difference of less than a second is a positive value, it can be determined that the internal time is delayed with respect to the correct time, and the internal time in seconds is advanced by 1 second (incremented by 1 second).

Further, the time of less than a second in the internal time is corrected. Thereby, the internal time is advanced by 400 msec, and corrected to 00: 00: 00.100 which is the correct time.

Operational Effect of Second Embodiment

After the GPS receiving circuit 45 acquires the time synchronization information, the time correction unit 53 is able to correct the internal time in seconds on the basis of the synchronization signal and the reception side time information (the time of less than a second) before the next timing of positive seconds. Thereby, the time period necessary for time correction can be shortened as compared with a case where the GPS receiving circuit 45 waits for the next timing of positive seconds and transmits data.

If the GPS receiving circuit 45 acquires the time synchronization information, the time correction unit 53 is able to correct the internal time even without acquiring the GPS time information. Thereby, compared with a case where the time correction unit 53 corrects the internal time after the GPS receiving circuit 45 acquires the time synchronization information and the GPS time information, the time period necessary for time correction can be shortened. Further, when the information acquisition unit 55 acquires the synchronization signal and the reception side time information which are output from the GPS receiving circuit 45, the GPS receiving circuit 45 is set in an inactive state. Thereby, the power consumption can be reduced as compared with a case where the GPS receiving circuit 45 is continuously operated even after the information acquisition unit 55 acquires the synchronization signal and the reception side time information.

In addition, with the same configuration as the electronic timepiece 1 of the first embodiment, the same operational effect can be obtained.

Another Embodiment

It should be noted that the invention is not limited to the above-described embodiments, and the invention includes variations, improvements, and the like within the scope of achieving the object of the invention.

In the first embodiment, the time correction unit 53 calculates the next timing of positive seconds on the basis of the synchronization signal and the time of less than a second in the reception side time information which are output from the GPS receiving circuit 45, and resets the second measurement timer at the next timing of positive seconds, thereby correcting the time of less than a second in the internal time, but the invention is not limited to this. For example, as in the second embodiment, there is provided a less-than-second measurement unit capable of measuring a time of less than a second in units of 1 msec or the like. When the time of less than a second in the internal time is determined by the measurement value of the less-than-second measurement unit, the time of less than a second may be corrected as follows.

That is, the time correction unit 53 corrects the measurement value of the less-than-second measurement unit on the basis of the synchronization signal and the time of less than a second in the reception side time information which are output from the GPS receiving circuit 45. Therefore, the time correction unit 53 may correct the time of less than a second in the internal time.

In the second embodiment, the time correction unit 53 corrects the measurement value of the less-than-second measurement unit on the basis of the synchronization signal and the time of less than a second in the reception side time information which are output from the GPS receiving circuit 45, thereby correcting the time less than the internal time of seconds, but the invention is not limited to this. For example, by calculating the next timing of positive seconds on the basis of the synchronization signal and the time of less than a second in the reception side time information and resetting the less-than-second measurement unit at the next timing of positive seconds, the time of less than a second in the internal time may be corrected.

In the second embodiment, when the control circuit 50 acquires the synchronization signal and the reception side time information which are output from the GPS receiving circuit 45, the GPS receiving circuit 45 thereafter does not output the synchronization signal or the reception side time information, but the invention is not limited to this.

For example, even when the control circuit 50 acquires the synchronization signal and the reception side time information, the GPS receiving circuit 45 may repeatedly output the synchronization signal and the reception side time information to the control circuit 50 a preset number of times.

As another embodiment, the error of the internal time with respect to the correct time is predicted. In accordance with whether or not the error is less than, for example, 500 msec, the time correction processing described in the second embodiment and the time correction processing described in the first embodiment may be switched and executed.

The error of the internal time with respect to the correct time can be predicted, for example, on the basis of the elapsed time from correcting the previous internal time, the clock precision of the crystal oscillator, and the like.

In this case, when the error is less than 500 msec, as in the second embodiment, the GPS receiving circuit 45 outputs the synchronization signal and the reception side time information (the time of less than a second) to the circuit 50, at the timing at which the time synchronization information can be acquired. Then, the control circuit 50 corrects the internal time on the basis of the synchronization signal and the time of less than a second in the reception side time information.

On the other hand, when the error is 500 msec or more, as in the first embodiment, the GPS receiving circuit 45 outputs the synchronization signal and the reception side time information (hours, minutes, and seconds, and the time of less than a second) to the control circuit 50, at the timing at which the time synchronization information and the GPS time information can be acquired. Then, the control circuit 50 corrects the hours, minutes, and seconds in the internal time on the basis of the hours, minutes, and seconds in the reception side time information, and corrects the time of less than a second in the internal time on the basis of the synchronization signal and the time of less than a second in the reception side time information.

In each of the above embodiments, the GPS satellite 100 is described as an example of the position information satellite, but the invention is not limited thereto. For example, satellites to be used in other global public navigation satellite systems (GNSS) such as Galileo (EU), GLONASS (Russia), and Beidou (China) can be applied as the position information satellites. Further, geostationary satellites such as geosynchronous satellite navigation reinforcement system (SBAS) and satellites such as regional satellite positioning systems (RNSS) such as quasi-zenith satellites that is able to search only specific areas can be applied.

The invention can be widely used not only for electronic timepieces but also for electronic devices (such as wrist-type devices and mobile phones) that receive satellite signals.

The entire disclosure of Japanese Patent Application No. 2017-055084, filed Mar. 21, 2017 is expressly incorporated by reference herein.

What is claimed is:

1. An electronic device comprising:

a receiver configured to receive a satellite signal and to be selectively set to each of a second synchronous mode and a second asynchronous mode; and a time corrector configured to correct an internal time, wherein, when the receiver is set the second asynchronous mode, the receiver acquires time synchronization information and satellite time information by receiving the satellite signal, detects update timing of seconds on the basis of the time synchronization information, and executes output processing of outputting a synchronization signal, which indicates output timing, and reception side time information including time difference information, which indicates a time difference between the update timing of seconds and the output timing, and time information of hours, minutes, and seconds based on the satellite time information, before next update timing of seconds, wherein the time corrector corrects the internal time on the basis of the synchronization signal and the reception side time information, and wherein, when the receiver is to the second synchronous mode, the receiver executes output processing of outputting a synchronization signal at a next update timing of seconds.

2. The electronic device according to claim 1, further comprising an information acquirer configured to acquire the synchronization signal and the reception side time information, which are output through the output processing, and sends the synchronization signal and the reception side time information to the time corrector, wherein in a case where the information acquirer fails to acquire the synchronization signal and the reception side time information which are output through the output processing, the receiver repeatedly executes the output processing at a preset synchronization signal output interval, and wherein a length of the synchronization signal output interval is changeable.

3. The electronic device according to claim 1, further comprising an information acquirer configured to acquire the synchronization signal and the reception side time information, which are output through the output processing, and sends the synchronization signal and the reception side time information to the time corrector, wherein the receiver outputs the synchronization signal during a preset synchronization signal output time period in the output processing, wherein in a case where the information acquirer is unable to acquire the synchronization signal during the synchronization signal output time period, the time corrector does not correct the internal time, and wherein a length of the synchronization signal output time period is changeable.

4. An electronic device comprising:

a receiver configured to receive a satellite signal and to be selectively set to each of a second synchronous mode and a second asynchronous mode; and a time corrector configured to correct an internal time, wherein, when the receiver is set the second asynchronous mode, the receiver acquires time synchronization information by receiving the satellite signal, detects update timing of seconds on the basis of the time synchronization information, and executes output processing of outputting a synchronization signal, which indicates output timing, and reception side time information including at least time difference information, which indicates a time difference between the update timing of seconds and the output timing, before next update timing of seconds, wherein the time corrector corrects the internal time on the basis of the synchronization signal and the reception side time information, and wherein, when the receiver is set to the second synchronous mode, the receiver executes output processing of outputting a synchronization signal at a next update timing of seconds.

5. The electronic device according to claim 4, further comprising an information acquirer configured to acquire the synchronization signal and the reception side time information, which are output through the output processing, and sends the synchronization signal and the reception side time information to the time corrector, wherein in a case where the information acquirer fails to acquire the synchronization signal and the reception side time information which are output through the output processing, the receiver repeatedly executes the output processing at a preset synchronization signal output interval, and wherein a length of the synchronization signal output interval is changeable.

6. The electronic device according to claim 4, further comprising an information acquirer configured to acquire the synchronization signal and the reception side time information, which are output through the output processing, and sends the synchronization signal and the reception side time information to the time corrector, wherein the receiver outputs the synchronization signal during a preset synchronization signal output time period in the output processing, wherein in a case where the information acquirer is unable to acquire the synchronization signal during the synchronization signal output time period, the time corrector does not correct the internal time, and wherein a length of the synchronization signal output time period is changeable.

7. A receiving device configured to be selectively set to each of a second synchronous mode and a second asynchronous mode, wherein the receiving device:

wherein, when in the second asynchronous mode, the receiving device acquires time synchronization information and satellite time information by receiving a satellite signal, detects update timing of seconds on the basis of the time synchronization information, and executes output processing of outputting a synchronization signal, which indicates output timing, and reception side time information including time difference information, which indicates a time difference between the update timing of seconds and the output timing, and time information of hours, minutes, and seconds based on the satellite time information, before next update timing of seconds.

8. A receiver configured to be selectively set to each of a second synchronous mode and a second asynchronous mode, wherein the receiving device:

wherein, when in the second asynchronous mode, the receiving device acquires time synchronization information by receiving a satellite signal, detects update timing of seconds on the basis of the time synchronization information, and executes output processing of outputting a synchronization signal, which indicates output timing, and reception side time information including at least time difference information, which indicates a time difference between the update timing of seconds and the output timing, before next update timing of seconds.

* * * * *